US010017872B2

(12) United States Patent
Browning et al.

(10) Patent No.: US 10,017,872 B2
(45) Date of Patent: Jul. 10, 2018

(54) METAL OXIDE FILMS WITH REFLECTIVE PARTICLES

(71) Applicant: Apple Inc., Cupertino, CA (US)

(72) Inventors: Lucy E. Browning, San Francisco, CA (US); Daniel T. McDonald, San Francisco, CA (US); Stephen B. Lynch, Portola Valley, CA (US); Brian S. Tryon, Los Gatos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/878,850

(22) Filed: Oct. 8, 2015

(65) Prior Publication Data

US 2016/0024680 A1 Jan. 28, 2016

Related U.S. Application Data

(63) Continuation of application No. 14/462,412, filed on Aug. 18, 2014, now Pat. No. 9,181,629, which is a continuation of application No. PCT/US2014/051527, filed on Aug. 18, 2014.

(60) Provisional application No. 61/897,786, filed on Oct. 30, 2013.

(51) Int. Cl.

| | |
|---|---|
| ***C25D 11/02*** | (2006.01) |
| ***C25D 15/00*** | (2006.01) |
| ***C25D 11/04*** | (2006.01) |
| ***C25D 11/16*** | (2006.01) |
| ***C25D 11/14*** | (2006.01) |

(52) U.S. Cl.

CPC ..... *C25D 11/02* (2013.01); *C25D 11/04* (2013.01); *C25D 11/14* (2013.01); *C25D 11/16* (2013.01); *C25D 15/00* (2013.01); *Y10T 428/12111* (2015.01)

(58) Field of Classification Search

None

See application file for complete search history.

(56) References Cited

U.S. PATENT DOCUMENTS

| | | | |
|---|---|---|---|
| 3,747,117 | A | 7/1973 | Fechter |
| 3,765,994 | A | 10/1973 | Quaintance et al. |
| 4,210,499 | A | 7/1980 | Hirono et al. |

(Continued)

FOREIGN PATENT DOCUMENTS

| | | | |
|---|---|---|---|
| CN | 85103365 | A | 12/1986 |
| CN | 1336878 | A | 2/2002 |

(Continued)

OTHER PUBLICATIONS

Chen et.al. Applied Surface Science. 256, 2010, 6518-6525.*

(Continued)

*Primary Examiner* — Vera Katz

(74) *Attorney, Agent, or Firm* — Dickinson Wright RLLP

(57) ABSTRACT

The embodiments described herein relate to anodic films and methods for forming anodic films. The methods described can be used to form anodic films that have a white appearance. Methods involve positioning reflective particles on or within a substrate prior to or during an anodizing process. The reflective particles are positioned within the metal oxide of the resultant anodic film but substantially outside the pores of the anodic film. The reflective particles scatter incident light giving the resultant anodic film a white appearance.

18 Claims, 26 Drawing Sheets

(56) References Cited

U.S. PATENT DOCUMENTS

| | | | | |
|---|---|---|---|---|
| 4,519,876 | A | 5/1985 | Lee et al. | |
| 4,753,863 | A | 6/1988 | Spanjer | |
| 4,972,061 | A | 11/1990 | Duley et al. | |
| 5,472,788 | A | 12/1995 | Benitez | |
| 5,510,015 | A | 4/1996 | Martinez et al. | |
| 6,083,871 | A | 7/2000 | Fromson et al. | |
| 6,127,050 | A | 10/2000 | Fromson et al. | |
| 6,139,713 | A | 10/2000 | Masuda et al. | |
| 6,180,415 | B1 | 1/2001 | Schultz et al. | |
| 6,238,847 | B1 | 5/2001 | Axtell, III et al. | |
| 6,271,162 | B1 | 8/2001 | Haug et al. | |
| 6,548,264 | B1 | 4/2003 | Tan et al. | |
| 6,613,161 | B2 | 9/2003 | Zheng et al. | |
| 6,777,098 | B2 | 8/2004 | Yeo | |
| 6,821,305 | B2 | 11/2004 | Yan | |
| 6,866,710 | B2 | 3/2005 | Heider et al. | |
| 6,884,336 | B2 | 4/2005 | Kia et al. | |
| 7,144,627 | B2 | 12/2006 | Halas et al. | |
| 7,173,276 | B2 | 2/2007 | Choi et al. | |
| 7,187,396 | B2 | 3/2007 | Carroll, Jr. et al. | |
| 8,029,554 | B2 | 10/2011 | Holman et al. | |
| 8,993,921 | B2 | 3/2015 | Browning et al. | |
| 9,493,876 | B2 | 11/2016 | Browning et al. | |
| 2002/0132105 | A1 | 9/2002 | Robertson et al. | |
| 2002/0171732 | A1 | 11/2002 | Carroll | |
| 2003/0001150 | A1 | 1/2003 | Iwasaki et al. | |
| 2003/0176563 | A1 | 9/2003 | Kuroda et al. | |
| 2004/0194235 | A1 | 10/2004 | Yan | |
| 2005/0069683 | A1* | 3/2005 | Aylward | G03C 1/85 428/195.1 |
| 2005/0175836 | A1 | 8/2005 | Kuehnle et al. | |
| 2005/0211566 | A1 | 9/2005 | Tomita et al. | |
| 2006/0066579 | A1 | 3/2006 | Bladt | |
| 2006/0197953 | A1 | 9/2006 | Perez et al. | |
| 2006/0254922 | A1 | 11/2006 | Brevnov et al. | |
| 2006/0260947 | A1* | 11/2006 | Kia | C25D 5/50 205/173 |
| 2007/0141342 | A1 | 6/2007 | Kuehnle et al. | |
| 2007/0190298 | A1 | 8/2007 | Hampden-Smith et al. | |
| 2007/0281140 | A1 | 12/2007 | Haubrich et al. | |
| 2007/0284261 | A1 | 12/2007 | Shimotani et al. | |
| 2008/0026207 | A1 | 1/2008 | Fink-Petri et al. | |
| 2008/0057293 | A1 | 3/2008 | Hatanaka et al. | |
| 2008/0073220 | A1 | 3/2008 | Doyle | |
| 2008/0274375 | A1 | 11/2008 | Ng et al. | |
| 2009/0022995 | A1 | 1/2009 | Graham et al. | |
| 2009/0120358 | A1 | 5/2009 | Harada et al. | |
| 2009/0130436 | A1* | 5/2009 | Harada | C23C 4/02 428/332 |
| 2009/0181262 | A1 | 7/2009 | Isaksson et al. | |
| 2009/0323171 | A1 | 12/2009 | Gibson | |
| 2010/0015558 | A1 | 1/2010 | Jarvis et al. | |
| 2010/0183869 | A1 | 7/2010 | Lin et al. | |
| 2010/0187119 | A1 | 7/2010 | Almond et al. | |
| 2010/0215926 | A1 | 8/2010 | Askin et al. | |
| 2010/0224026 | A1 | 9/2010 | Brennan Fournet et al. | |
| 2011/0008602 | A1 | 1/2011 | Peeters | |
| 2011/0123737 | A1 | 5/2011 | Nashner | |
| 2011/0193928 | A1 | 8/2011 | Zhang | |
| 2011/0284381 | A1 | 11/2011 | Cabot et al. | |
| 2012/0021120 | A1 | 1/2012 | Feldstein | |
| 2013/0224406 | A1 | 8/2013 | Chang et al. | |
| 2014/0076600 | A1 | 3/2014 | Browning et al. | |
| 2014/0193607 | A1 | 7/2014 | Browning et al. | |
| 2014/0209467 | A1 | 7/2014 | Miao et al. | |
| 2015/0090598 | A1* | 4/2015 | Tatebe | C25D 11/045 205/50 |
| 2015/0132541 | A1 | 5/2015 | McDonald et al. | |
| 2015/0176146 | A1 | 6/2015 | Browning et al. | |
| 2015/0225867 | A1* | 8/2015 | Tatebe | C25D 11/12 205/50 |

FOREIGN PATENT DOCUMENTS

| | | | |
|---|---|---|---|
| CN | 102834551 | A | 12/2012 |
| CN | 103014706 | A | 4/2013 |
| DE | 10134559 | A1 | 2/2003 |
| EP | 993964 | A2 | 4/2000 |
| EP | 1110660 | A2 | 6/2001 |
| EP | 2649224 | A2 | 10/2013 |
| JP | S60197897 | A | 10/1985 |
| JP | S62020898 | A | 1/1987 |
| JP | S63179098 | A | 7/1988 |
| JP | S63206499 | A | 8/1988 |
| JP | 01205094 | A | 8/1989 |
| JP | H06317921 | A | 11/1991 |
| JP | H10121292 | A | 5/1998 |
| JP | 2009221140 | A | 10/2009 |
| JP | 2010072616 | A | 4/2010 |
| JP | 2013-084954 | | 5/2013 |
| KR | 1020080031966 | A | 4/2008 |
| KR | 20080098331 | A | 11/2008 |
| TW | 200524460 | A | 7/2005 |
| TW | 200714747 | A | 4/2007 |
| WO | 2011077899 | A1 | 6/2011 |
| WO | WO2012076467 | A2 | 6/2012 |
| WO | WO2014/130451 | | 8/2014 |
| WO | WO2014/130452 | | 8/2014 |
| WO | WO2014/130453 | | 8/2014 |

OTHER PUBLICATIONS

AlMawlawi, et.al. J. Appl. Phys., 70, 1991, 4421.*

International Search Report and Written Opinion dated Nov. 24, 2014 for PCT Application No. PCT/US2014/051527.

Sunada, et al. "Dielectric properties of Al—Si composite oxide films formed on electropolished and DC-etched aluminum by electrophoretic sol-gel coating and anodizing." J. Solid State Electrochem. vol. 11, No. 10:1375-1384 (Oct. 2007).

Chen et al., "The effect of anodizing voltage on the electrical properties of A1-Ti composite oxide film on aluminum." J. Electroanalytic Chem. vol. 590, No. 1:26-31 (May 2006).

Furneaux et al., "The formation of controlled-porosity membranes from anodically oxidized Aluminium", Nature, vol. 337, Jan. 1989, pp. 147-149.

Masuda, "Highly ordered metal nanohole arrays based on anodized alumina", Solid State Physics, vol. 31, No. 5, Dec. 1996, pp. 493-499.

PCT/US2013/047163. International Search Report and Written Opinion (dated Sep. 25, 2013).

Taiwanese Patent Application No. 104120036—Office Action dated Feb. 15, 2016.

Korean Patent Application No. 10-2015-7001318—Notice of Preliminary Rejection dated Feb. 28, 2016.

Japanese Patent Application No. 2015-518627—First Office Action dated Feb. 29, 2016.

Chinese Application for Invention No. 201380032781.6—First Office Action dated Apr. 27, 2016.

Hashimoto et al., "Ag Nanoparticle Films for Color Applications", Sep. 2011, Sep. 2011, Mater. Res. Symp. Proc., vol. 1343, pp. 1-6.

PCT/US2013/059793. Int'l Search Report-Written Opinion (dated Dec. 23, 2013).

Wang, et al. "Tuning color by pore depth of metal-coated porous alumina-" Nanotechnology, vol. 22, No. 30, Art. No. 305306, pp. 1-6 (2011 ).

Huang, et al. "Optical characteristics of pore size on porous anodic aluminum oxide films with embedded silver nanoparticles." Sensors & Actuators A: Physical, vol. 180, pp. 49-54. (Apr. 7, 2012).

Hu, et al. "Photosensitive gold-nanoparticle-embedded dielectric nanowires-" Nature Materials vol. 5, No. 2, pp. 102-106 (2006).

Li, et al., "Brilliant and tunable color by changing pore diameter of metal-coated porous anodic alumina." SPIE Proceedings, vol. 8564, pp. 85640-1-85640-6 (Nov. 20, 2012).

Korean Patent Application No. 2015-7001318—First Office Action dated Sep. 26, 2016.

Regone et. al. J. Mat. Process. Tech., 172 (2006), 146-151.

(56) References Cited

OTHER PUBLICATIONS

Curran et. al. Surface and Coatings Technology, 199 (2005), 168-176.
Chinese Application Patent No. 201480059602.2—Office Action dated Mar. 24, 2017.
European Patent Application No. 14857882.6—Extended European Search Report dated Jun. 21, 2017.
Vreeling et al., "Laser melt injection in aluminum alloys: on the role of the oxide skin", ACTA Materialia., vol. 48, No. 17, Nov. 2000 (Nov. 2000), pp. 4225-4233, 9 pages.
Korean Patent Application No. 10-2017-7017085—Office Action dated Jul. 20, 2017.
Japanese Patent Application No. 2016-153985—Office Action dated Sep. 29, 2017.
Chinese Application Patent No. 201480059602.2—Second Office Action dated Sep. 27, 2017.
Chinese Application Patent No. 201480059602.2—Third Office Action dated Feb. 27, 2018.
Japanese Patent Application No. 2016-153985—Final Rejection dated Apr. 20, 2018.

* cited by examiner

METAL OXIDE FILMS WITH REFLECTIVE PARTICLES

CROSS-REFERENCE TO RELATED APPLICATIONS

This application is a continuation of U.S. application Ser. No. 14/462,412, filed Aug. 18, 2014 entitled METHODS FOR PRODUCING WHITE APPEARING METAL OXIDE FILMS BY POSITIONING REFLECTIVE PARTICLES PRIOR TO OR DURING ANODIZING PROCESSES," which is a continuation of International PCT Application No. PCT/US2014/051527, filed Aug. 18, 2014, and claims priority to U.S. Provisional Application No. 61/897,786, filed Oct. 30, 2013 entitled "METHODS FOR PRODUCING WHITE APPEARING METAL OXIDE FILMS BY POSITIONING REFLECTIVE PARTICLES PRIOR TO OR DURING ANODIZING PROCESSES," each of which is incorporated herein by reference in its entirety.

FIELD OF THE DESCRIBED EMBODIMENTS

This disclosure relates generally to methods for producing anodic films. More specifically, disclosed are methods for producing anodic films having white appearances by using reflective particles.

BACKGROUND

Anodizing is an electrolytic passivation process used to increase the thickness of a natural oxide layer on a surface of metal part, where the part to be treated forms the anode electrode of an electrical circuit. The resultant metal oxide film, referred to as an anodic film, increases the corrosion resistance and wear resistance of the surface of a metal part. Anodic films can also be used for a number of cosmetic effects. For example, techniques for colorizing anodic films have been developed that can provide an anodic film with a perceived color. For example, blue dyes can be infused within pores of an anodic film that cause the anodic film to appear blue as viewed from a surface of the anodic film.

In some cases, it can be desirable to form an anodic film having a white color. However, conventional attempts to provide a white appearing anodic film have resulted in films that appear to be off-white or muted grey, and not a crisp appearing white that many people find appealing.

SUMMARY

This paper describes various embodiments that relate to white appearing anodic films and methods for forming the same.

According to one embodiment, a method for forming a metal oxide film on a metal substrate is described. The method includes positioning reflective particles within the metal substrate. The method also includes converting at least a portion of the metal substrate to the metal oxide film such that the metal oxide film includes at least part of the reflective particles embedded therein. The embedded reflective particles impart a white appearance to the metal oxide film.

According to another embodiment, a part is described. The part includes a metal substrate. The part also includes a metal oxide film formed on the metal substrate. The metal oxide film includes a pattern of first metal oxide portions surrounded by a second metal oxide portion. Each of the first metal oxide portions includes reflective particles embedded therein such that the metal oxide film takes on a white appearance.

According to a further embodiment, a method for forming a metal oxide film on a metal substrate is described. The method includes adding the reflective particles within an electrolytic bath. The method also includes forming the metal oxide film by anodizing the metal substrate in the electrolytic bath such that at least part of the reflective particles are embedded within the metal oxide film during the anodizing. The embedded reflective particles impart a white appearance to the metal oxide film.

These and other embodiments will be described in detail below.

BRIEF DESCRIPTION OF THE DRAWINGS

The described embodiments and the advantages thereof may best be understood by reference to the following description taken in conjunction with the accompanying drawings. These drawings in no way limit any changes in form and detail that may be made to the described embodiments by one skilled in the art without departing from the spirit and scope of the described embodiments.

DETAILED DESCRIPTION OF EXAMPLE EMBODIMENTS

Figure 1A:
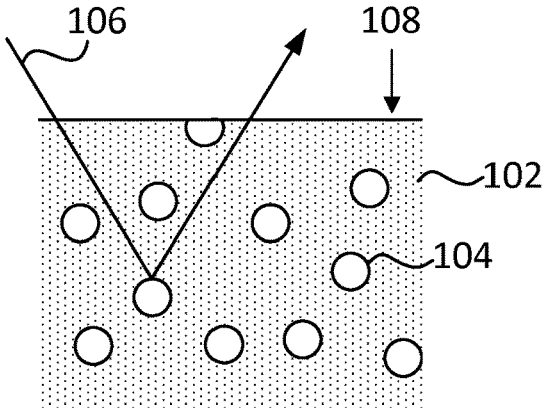
FIGS. 1A-1C illustrate various light scattering mechanisms for providing a perceived white appearance to a metal oxide film.

Representative applications of methods according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

This application relates to various embodiments of methods and apparatuses for improving the cosmetics and whiteness of metal oxide coatings. Methods include positioning reflective particles on or within a substrate prior to or during an anodizing process in such a way that the resultant metal oxide film appears white. The white appearing metal oxide films are well suited for providing protective and attractive surfaces to visible portions of consumer products. For example, methods described herein can be used for providing protective and cosmetically appealing exterior portions of metal enclosures and casings for electronic devices, such as those manufactured by Apple Inc., based in Cupertino, Calif.

The present application describes various methods of forming a metal layer on a substrate and then converting at least a portion of the metal layer to a metal oxide layer. As used herein, the terms "film", "layer", and "coating" are used interchangeably. In some embodiments, the metal layer is an aluminum layer. Unless otherwise described, as used herein, "aluminum" and "aluminum layer" can refer to any suitable aluminum-containing material, including pure aluminum, aluminum alloys or aluminum mixtures. As used herein, "pure" or "nearly pure" aluminum generally refers to aluminum having a higher percentage of aluminum metal compared to aluminum alloys or other aluminum mixtures. As used herein, the terms oxide film, oxide layer, metal oxide film, and metal oxide layer may be used interchangeably and can refer to any appropriate metal oxide film. In some embodiments, the metal oxide layer is converted to a metal oxide layer using an anodizing process. Thus, the metal oxide layer can be referred to as an anodic film.

In general, white is the color of objects that scatter nearly all incident visible wavelengths of light. Thus, a metal oxide film can be perceived as white when nearly all visible wavelengths of light incident a top surface of the metal oxide film are scattered. One way of imparting a white appearance to a metal film is by embedding reflective particles within the film. The particles can influence the scattering of light from the metal oxide film through reflection, refraction, and diffraction. Reflection involves a change in direction of the light when it bounces off a particle within the film. Refraction involves a change in the direction of light as it passes from one medium to another, such as from the oxide film medium and the particle medium. Diffraction involves a change in direction of light as it moves around a particle in its path.

Figure 1B:
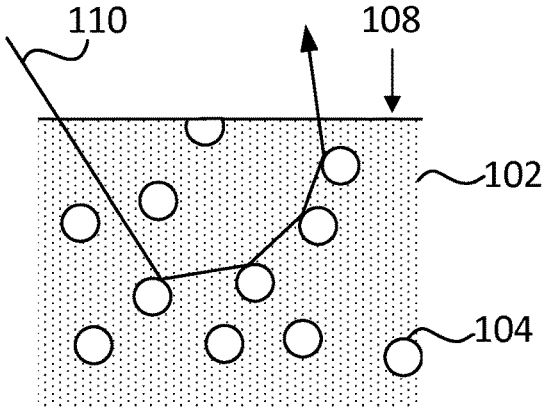
Figure 1C:
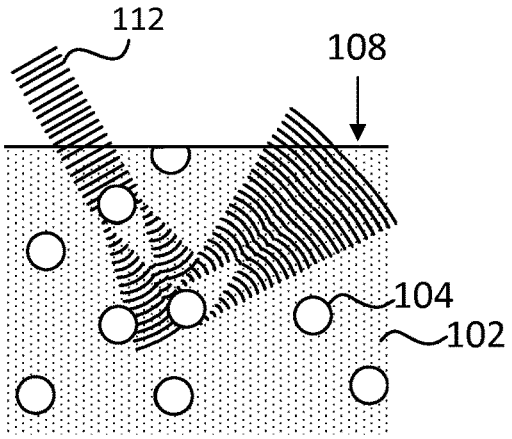

FIGS. 1A-1C illustrate how particles in a metal oxide film can scatter incident light by reflection, refraction and diffraction, respectively. At FIG. 1A, light ray 106 enters metal oxide film 102 having particles 104 embedded therein. As shown, light ray 106 bounces off one of particles 104 and exits top surface 108 of oxide film 102. In this way, light ray 106 is reflected off a particle 104. At FIG. 1B, light ray 110 enters metal oxide film 102 and changes direction when it encounters a first particle 104. Light ray 110 then encounters a second, third, and fourth particle 104, each time changing direction, until light ray 110 finally exits top surface 108 of oxide film 102. In this way, light ray 110 is refracted by several particles 104 within oxide film 102. At FIG. 1C, incoming light is depicted as light wave 112. Light wave 112 enters metal oxide film 102 and encounters a first particle 104, which causes light wave 112 to diffract. In diffraction, light wave 112 spreads out and scatters in different directions. Light wave 112 can then encounter a second particle 104, which causes further diffraction until the light wave 112 exits top surface 108 of oxide film. Thus, incident light can be scattered off of particles 104 by way of reflection, refraction, and diffraction, imparting a white appearance to oxide film 102 as viewed from top surface 108. It should be noted that reference made herein to "reflective particles" can refer to particles that can reflect, refract, and/or diffract visible light when positioned within an oxide film. In some embodiments, the particles are required to highly reflect, refract, and/or diffract incoming visible light in order to provide a sufficiently white metal oxide film.

Generally, the higher the refractive index of the particles 104, the greater amount of scattering will occur from oxide film 102. The reflectivity of a particle is proportional to its refractive index. Thus, particles having a high refractive index are generally highly reflective. For embodiments described herein, any suitable type of particles capable of interacting with incoming light such that the metal oxide film appears white can be used. In some embodiments, the particles have a high refractive index. In some embodiments, particles include those made of metal oxides such as titanium oxide, zirconium oxide, zinc oxide, and aluminum oxide. In some embodiments, metal particles such as aluminum, steel, or chromium particles are used. In some embodiments, carbides such as titanium carbide, silicon carbide, or zirconium carbide is used. In some embodiments, a combination of one or more of metal oxide, metal, and carbide particles is used. It should be understood that the above examples are not meant to represent an exhaustive list of particles that can be used in accordance with the embodiments described herein.

Figure 2:
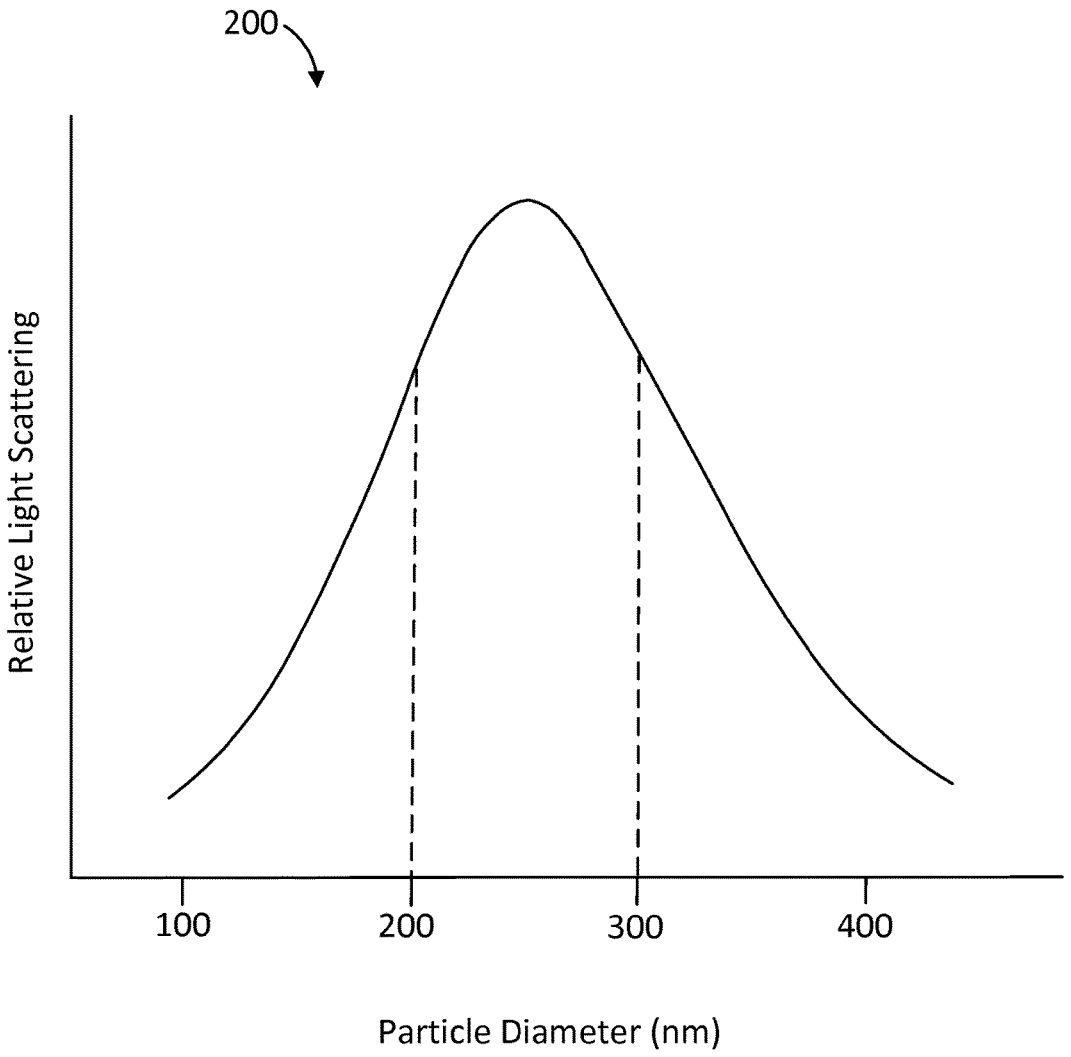
FIG. 2 shows a graph indicating relative light scattering as a function of average particle diameter.

In addition to the material of the particles, the size of the particles can affect the amount of light scattering that occurs. This is because the particle size can affect the amount of light refraction that occurs. FIG. 2 shows graph 200 showing relative light scattering as a function of average particle diameter in nanometers (nm). As shown, particles having an average diameter ranging from about 200 and 300 nm exhibit the highest amount of light scattering. This range corresponds to about half the wavelength of visible light. Particles having an average diameter of less than 200 nm or greater than 300 nm can also produce an anodic film having a white appearance. However, more of the particles having diameters of less than 200 nm or greater than 300 nm will be needed in order to produce a film having the same amount of whiteness as films with particles having diameters between about 200 and 300 nm.

The shape of the particles can also affect the amount of white appearance of an anodic film. In some embodiments, particles having a roughly spherical shape scattered light most efficiently, and thereby impart the whitest appearance to a film. The quantity of particles within the oxide film can vary depending on desired cosmetic and structural properties of the oxide film. It is generally desirable to use enough particles to create a white appearing oxide film but not so many particles that the oxide film becomes highly stressed. Too many particles can cause the oxide film to lose its structural integrity and cause cracks within the film.

Figure 3:
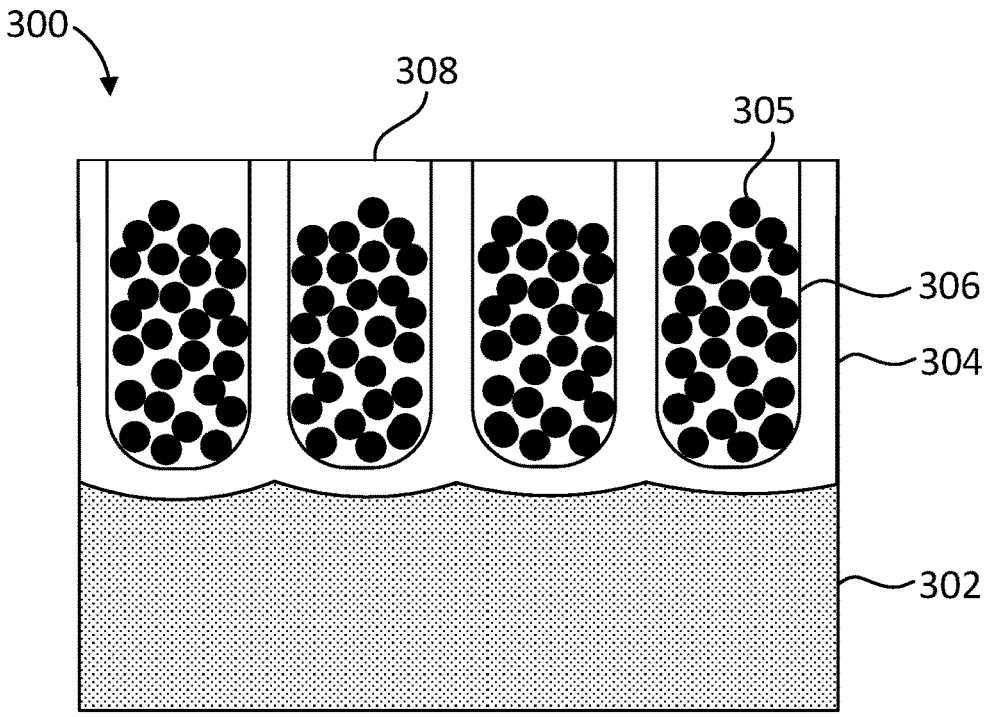
FIG. 3 (Prior Art)
FIG. 3 shows a cross-section view of a part after undergoing a traditional coloring method.

In embodiments described herein, reflective particles are situated on a substrate before an anodizing process or during an anodizing process. This results in a different placement of particles within the anodic film compared to anodic films colored using traditional methods. In traditional methods, dye is deposited into the pores of the anodic film after the anodic film is already formed. To illustrate, FIG. 3 shows a close-up cross-section view of part 300 after undergoing a traditional coloring method. During an anodizing process, a portion of substrate 302 is converted to anodic film 304. Anodic pores 306 grow in a perpendicular direction with respect to top surface 308 and are highly ordered in that they are parallel and evenly spaced with respect to each other. After a portion of substrate 302 is converted to anodic film 304, dye particles 305 are deposited within pores 306, imparting a color to substrate 302 in accordance with the color of dye particles 305.

Figure 4:
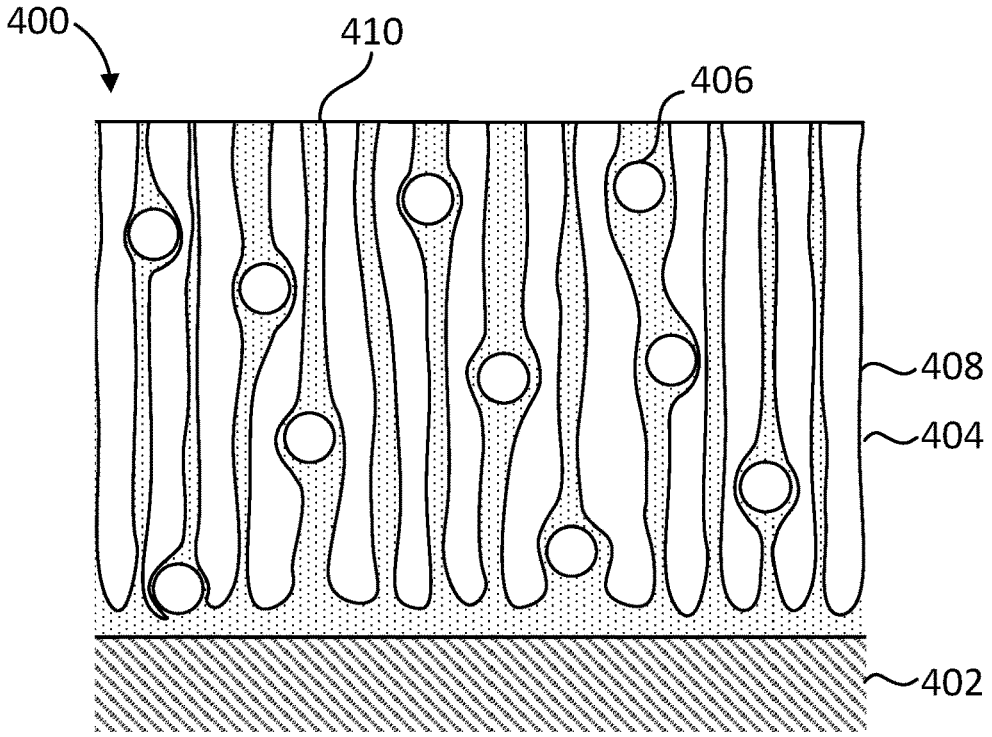
FIG. 4 shows a cross-section view of a part after undergoing a particle embedding procedure prior to or during an anodizing process.

In the embodiments described herein, methods involve embedding particles within a substrate prior to anodizing or during anodizing. FIG. 4 shows a close-up cross-section view of part 400 after undergoing a particle embedding procedure prior to or during an anodizing process. Particles 406 are embedded within substrate 402 before or during an anodizing process. During the anodizing process, at least a portion of substrate 402 is converted to anodic film 404. Since particles 406 are already embedded within substrate 302 prior to the anodizing process or are embedded within anodic film 404 during an anodizing process, pores 408 grow around particles 406. That is, pores 408 proximate to particles 406 curve around particles 406 during the anodizing process. In this way, particles 406 can be positioned within the oxide material of metal oxide layer 404 but outside of pores 408.

As described above, the material, average size, shape, and amount of particles 406 can be chosen such that the resultant oxide layer 404 has a white appearance as viewed from top surface 410. In some embodiments, the material, average size, and shape of particles 406 are chosen to maximize light scattering (e.g., through reflection, refraction, and diffraction). Particles 406 should be large enough such that visible light incident top surface 410 can scatter off particles 406, but not so large as to substantially disrupt the pore structure of oxide layer 404 and negatively affect the structural integrity and/or cosmetic quality of oxide layer 404. In some embodiments, the average diameter of particles 406 ranges from about 200 nm to about 300 nm. In other embodiments, the averaged diameter of particles 406 is less than about 200 nm and/or greater than about 300 nm. Anodizing generally occurs until a target thickness for the oxide layer 404 is achieved. In some embodiments, oxide layer 404 is grown to a thickness ranging from about 5 to 50 microns.

The amount of perceived whiteness of an oxide film can be measured using any of a number of color analysis techniques. For example, a color opponent process scheme, such as an L,a,b (Lab) color space based in CIE color perception schemes, can be used to determine the perceived whiteness of different oxide film samples. The Lab color scheme can predict which spectral power distributions (power per unit area per wavelength) will be perceived as the same color. In a Lab color space model, L indicates the amount of lightness, and a and b indicate color-opponent dimensions. In some embodiments described herein, the white metal oxide films have L values ranging from about 85 to about 100 and a,b values of nearly 0. Therefore, these metal oxide films are bright and color-neutral.

Different methods for positioning reflective particles within a metal oxide film in accordance with described embodiments will now be described. In some embodiments, methods involve positioning the particles on or within a substrate prior to an anodizing process; these methods will be described below with reference to FIGS. 5-12. In some embodiments, methods involve forming a composite material that includes particles dispersed within a metal material prior to an anodizing process; these methods will be described below with reference to FIGS. 13-16. In some embodiments, methods involve positioning particles within an anodic film during an anodizing process; these methods will be described below with reference to FIGS. 17-18. It should be noted that metal substrates in the embodiments described below can be made of any of a number of suitable metals. In some embodiments, the metal substrates include pure aluminum or aluminum alloy.

Co-Plating Metal with Reflective Particles

Figure 5:
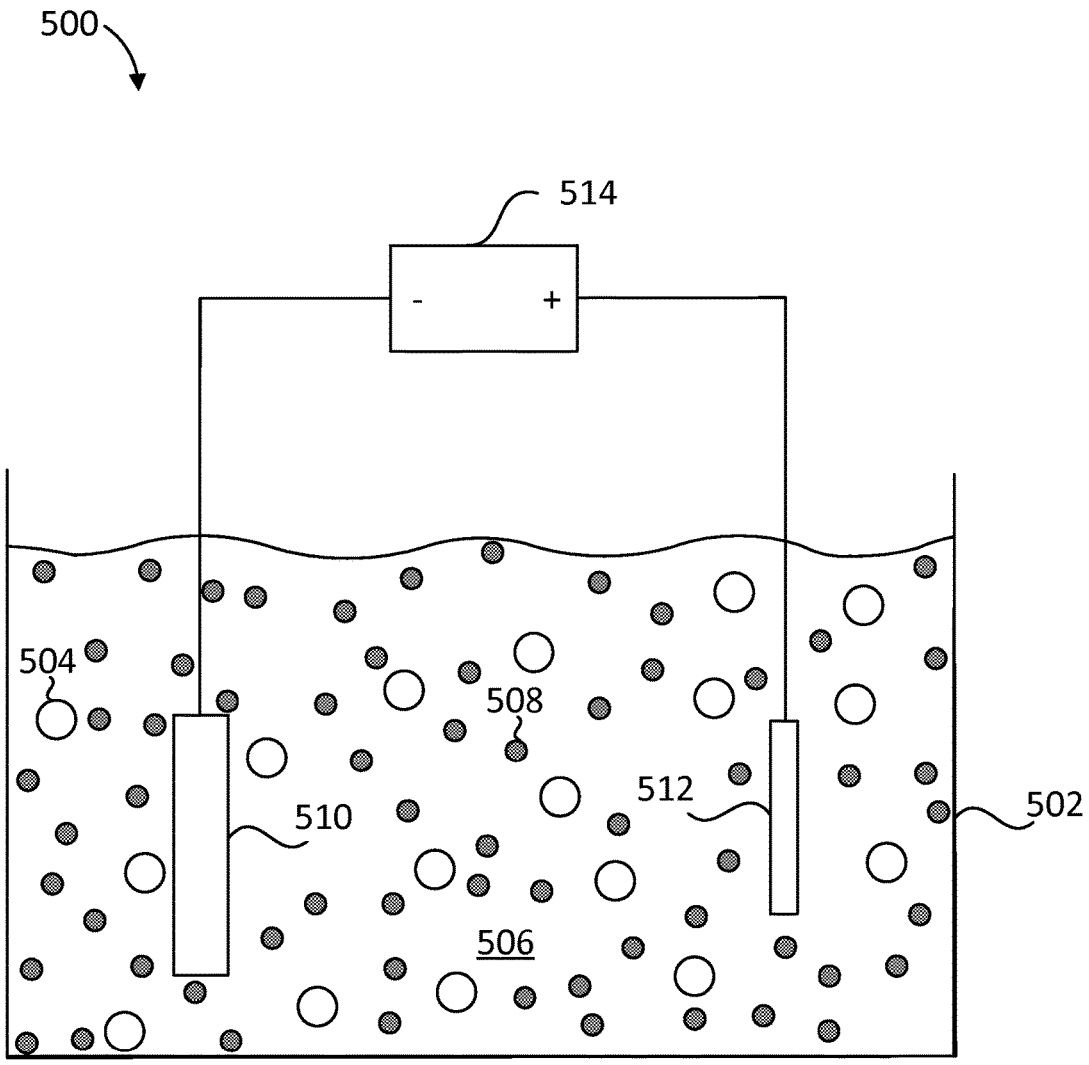
FIG. 5 shows an electrolytic plating cell configured to co-deposit metal with reflective particles.

One method for positioning reflective particles within a substrate prior to anodizing involves a co-deposition plating process. During the plating process, reflective particles are co-deposited with metal onto a part resulting in a plated metal layer having reflective particles deposited therein. FIG. 5 shows electrolytic plating cell 500 configured to co-deposit metal ions 508 with reflective particles 504 onto a part. Plating cell 500 includes container or tank 502, power supply 514, cathode (part) 510, anode 512, and plating bath 506. Plating bath 506 includes a mixture of reflective particles 504 and dissolved metal ions 508. Plating bath 506 can include any of a number of suitable chemicals to help the dissolution of metal ions 508. During a plating process, power supply 514 applies a voltage across part 510 and anode 512, which causes positively charged metal ions 508 to migrate toward part 510. Particles 504 become entrained in the flow of metal ions 508 and also move toward part 510. Particles 504 then become co-deposited onto part 510 along with metal ions 508.

Figure 6A:
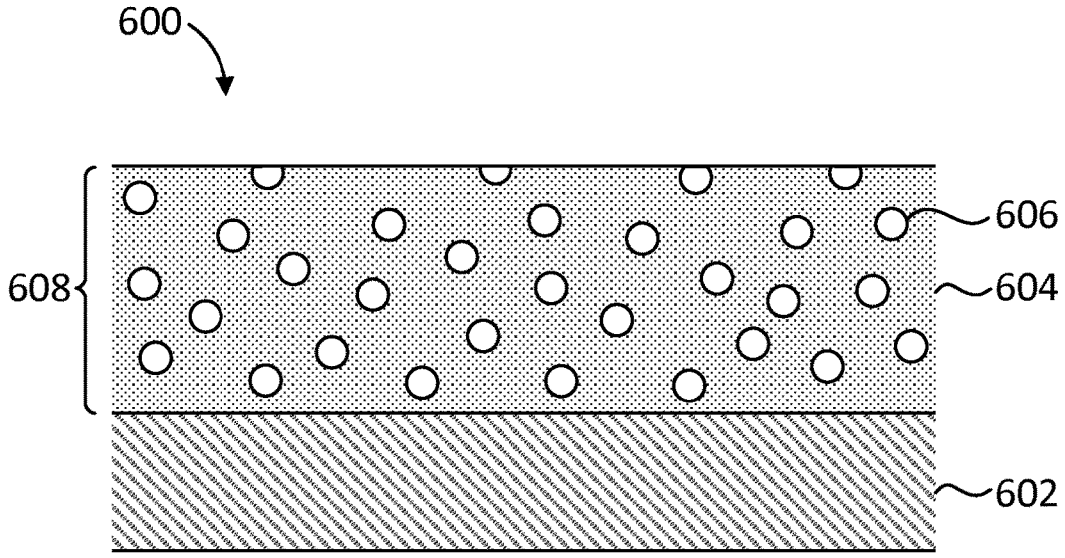
FIGS. 6A-6B show cross-section views of a part undergoing a co-plating process involving co-deposition of metal and reflective particles.
Figure 6B:
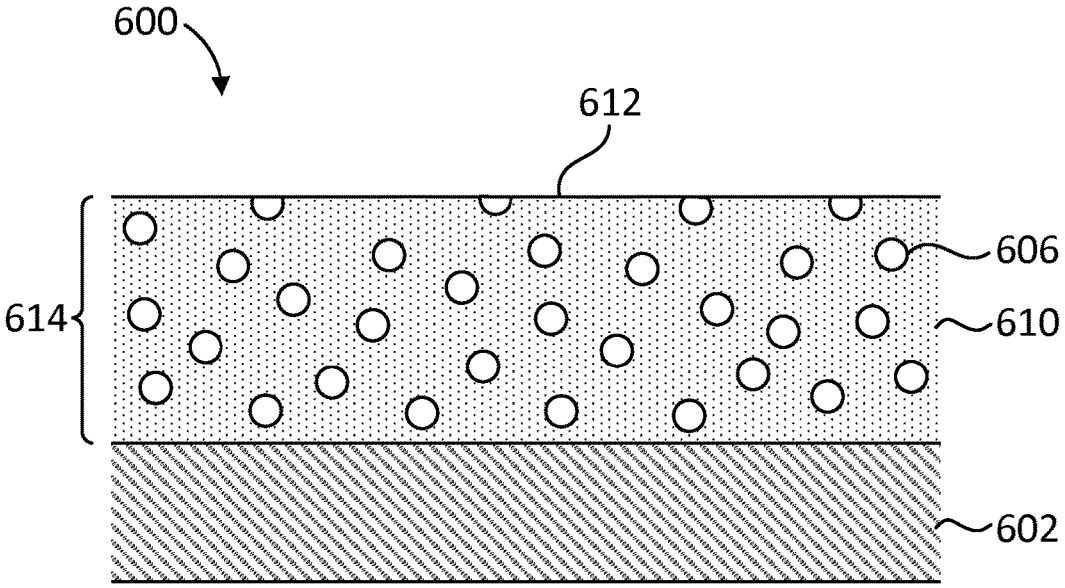

FIGS. 6A-6B show cross-section views of part 600 undergoing a co-deposition process and an anodizing process in accordance with described embodiments. At FIG. 6A, part 600 has undergone a deposition process whereby metal 604 is deposited along with particles 606 onto a surface of substrate 602. The resultant aggregate metal layer 608 includes metal 604 with particles 606 embedded therein. Aggregate metal layer 608 can be formed using any suitable process, including the co-plating process described above with reference to FIG. 5. Aggregate metal layer 608 can be deposited to any suitable thickness. In some embodiments, aggregate metal layer 608 is plated to a thickness ranging from about 5 micrometers to about 50 micrometers.

After the plating process is complete, part 600 can then be exposed to an anodizing process. At FIG. 6B, metal 604 of aggregate metal layer 608 is at least partially converted to metal oxide 610 using an anodizing process, forming aggregate metal oxide layer 614. Anodizing involves exposing part 600 to an electrolytic process, whereby part 600 acts as the anode and at least a portion of metal 604 become oxidized. Any suitable anodizing process can be used. After the anodizing process, particles 606 remain positioned with metal oxide 610. Since particles 606 are positioned within metal 604 prior to anodizing, the pores of metal oxide 610 grown around particles 606, similar to as described above with reference to FIG. 4. As described above, particles 606 can be chosen such that they scatter incident light through reflection, refraction, and diffraction, thereby imparting a white appearance to aggregate metal oxide layer 614 as viewed from top surface 612.

Figure 7:
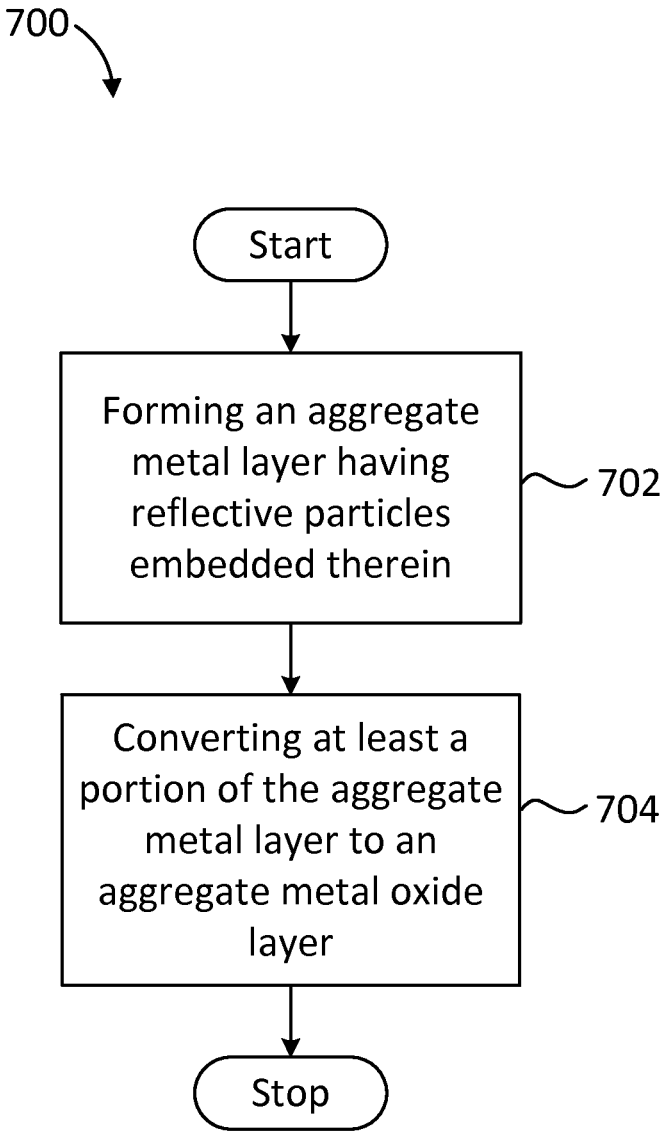
FIG. 7 shows a flowchart indicating steps involved in forming a white metal oxide film using a co-plating process as described with reference to FIGS. 5 and 6A-6B.

FIG. 7 shows flowchart 700 indicating steps involved in forming a white metal oxide film using co-deposition of metal with reflective particles and anodizing. At 702, an aggregate metal layer having reflective metal particles embedded therein is formed. The aggregate metal layer can be formed using a co-plating process whereby the particles are plated onto a substrate along with metal ions. The concentration of particles in the electroplating solution can vary depending, in part, upon the desired concentration of particles in the plated metal. At 704, at least a portion of the aggregate metal layer is converted to an aggregate metal oxide layer. In some embodiments, the conversion is accomplished using an anodizing process. The resultant aggregate metal oxide layer scatters incident light and has a white appearance.

Thermal Infusion of Reflective Particles

Another method for positioning reflective particles within a substrate prior to anodizing involves thermal infusion. In a thermal infusion procedure, localized portions of a metal substrate are melted into liquid or partial liquid form. Reflective particles are then allowed to mix in with the melted metal portions. FIGS. 8A-8F and 9A-9E illustrate cross-sectional views of parts 800 and 900 using two embodiments of thermal infusion procedures. At FIG. 8A, a solution 804 is disposed on a surface of metal substrate 802. Solution 804 has reflective particles 806 dispersed therein. Solution 804 is chosen such that particles 806 can be dispersed but not be substantially dissolved therein. Thus, the chemical nature of solution 804 (e.g. aqueous, non-aqueous, acidic, alkaline) will depend, on part, on the material of particles 806. In some embodiments, solution 804 is heated, either by heating solution 804 prior to dispensing onto substrate 802 or by heating substrate 802 that will then heat solution 804.

At 8B, portions 808 of substrate 802 are thermally treated such that portions 808 are melted into liquid or partial liquid form. In some embodiments, portions 808 are melted using a thermal spray method in which a flame locally heats portions of substrate 802. In some embodiments, portions 808 are melted using a laser beam. When the laser beam is directed to a surface of substrate 802, laser energy is transferred in the form of heat to portions 808 proximate to the laser beam. These portions 808 then melt or partially melt. The wavelength of the laser beam and dwell time at each portion 808 can vary depending, in part, upon the material of substrate 802. The wavelength and dwell time should be chosen such that energy from the laser beam can be absorbed in the form of heat by substrate 802. In some embodiments, the laser beam and dwell time are appropriate to melt portions 808 but not melt or change the shape of reflective particles 806. In some embodiments where substrate 802 includes aluminum, the laser beam wavelengths ranges from low ultraviolet to infrared are used.

In some embodiments, a laser can be used to melt portions of substrate 802 in a particular pattern. In some embodiments, the laser is scanned over the surface of substrate 802 such that an ordered array of melted portions 808 is formed. In some embodiments, the ordered array is such that each of the melted portions 808 is equidistant from each other. In some embodiments, a substantially random of melted portions 808 is formed. In some embodiments, melted portions 808 are formed around edges or a perimeter of a feature of substrate 802. In some embodiments, the laser beam is scanned such that melted portions 808 form a logo or writing. In some embodiments, a pulsed laser is used wherein each melted portion 808 corresponds with a pulse of the laser. In some embodiments, each melted portion 808 is pulsed by a laser beam more than one time. In some embodiments, a continuous laser is used, wherein the laser beam or the part is moved quickly between each melted portion 808.

Figure 8A:
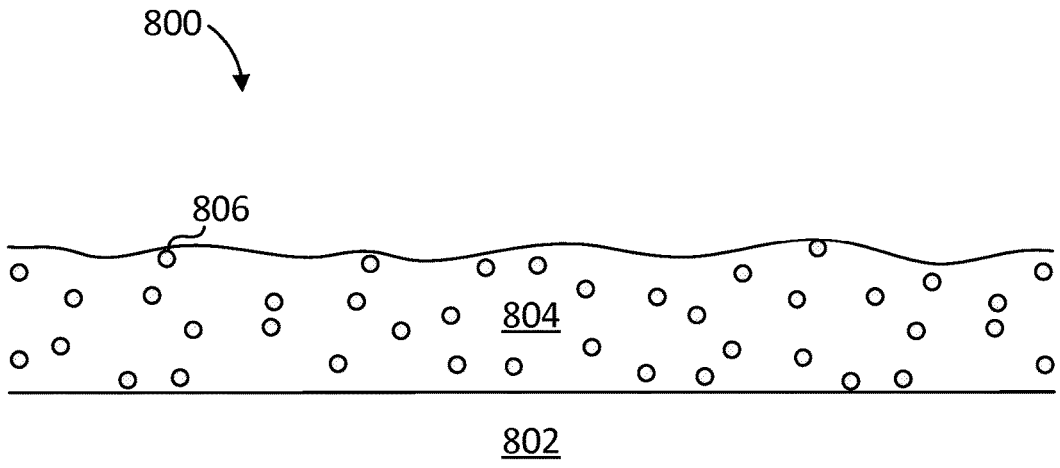
FIGS. 8A-8F shows cross-sectional views of a part undergoing a thermal infusion procedure followed by an anodizing process.
Figure 8B:
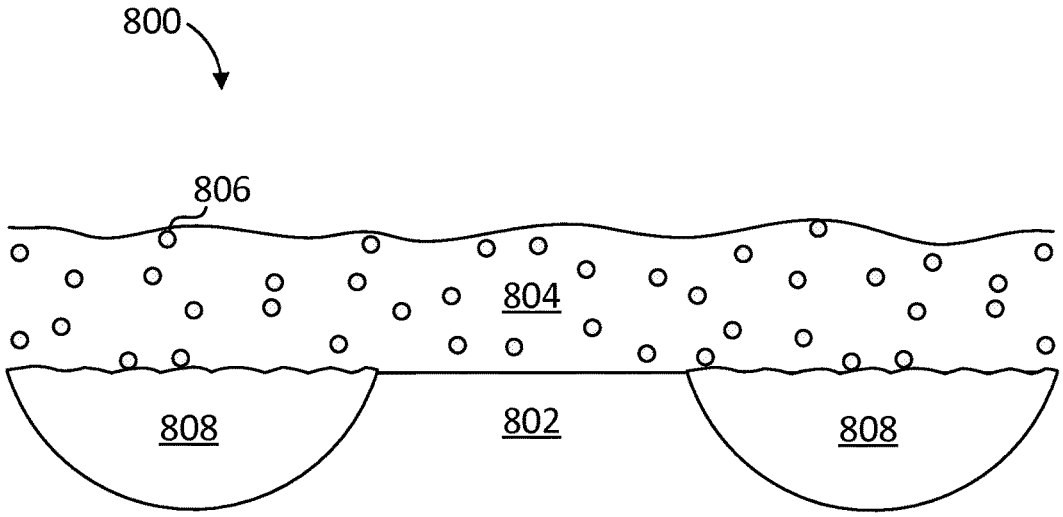
Figure 8C:
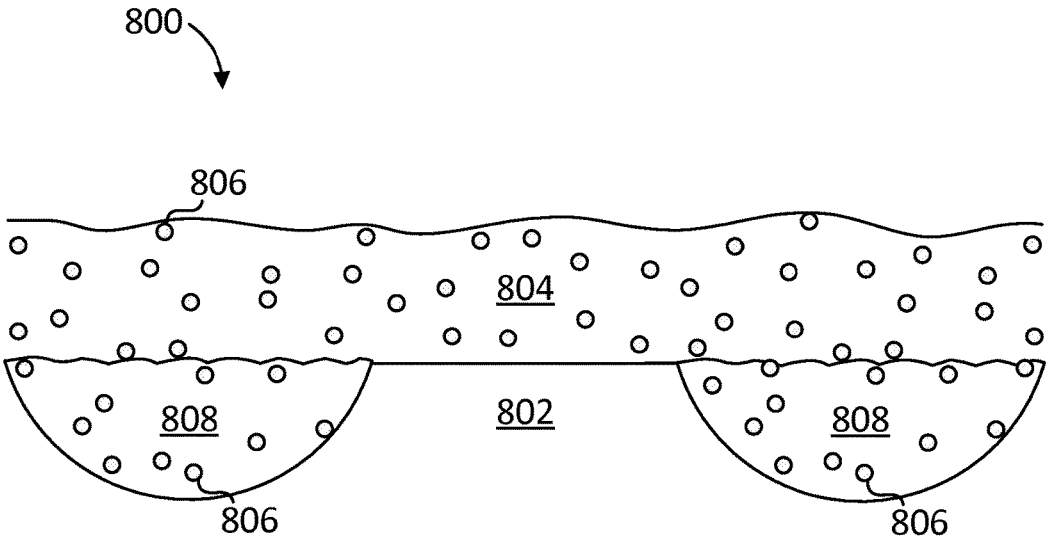
Figure 8D:
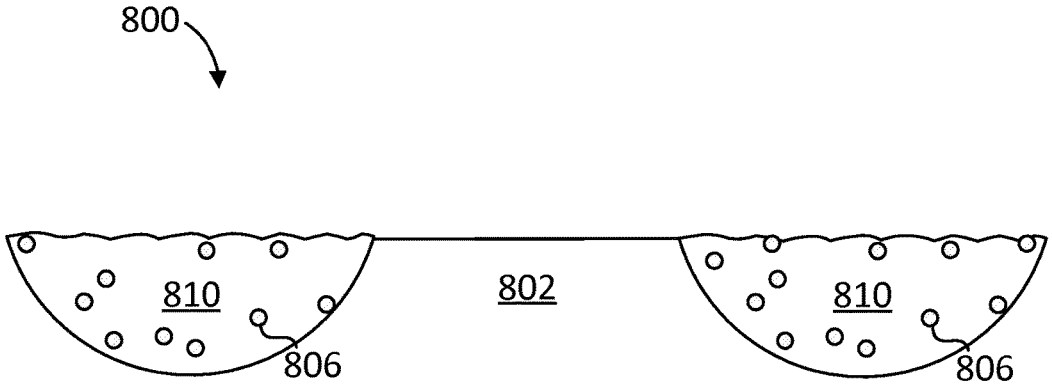

At FIG. 8C, particles 806 intermingle with the melted metal and become infused within melted portions 808. At FIG. 8D, melted portions 808 are allowed to solidify into re-solidified metal portions 810 and solution 804 is removed. As shown, particles 806 remain within re-solidified metal portions 810. Since re-solidified metal portions 810 have been melted and re-solidified, these portions can have a different microstructure than surrounding substrate 802. In some embodiments, re-solidified metal portions 810 have a crystalline microstructure.

Figure 8E:
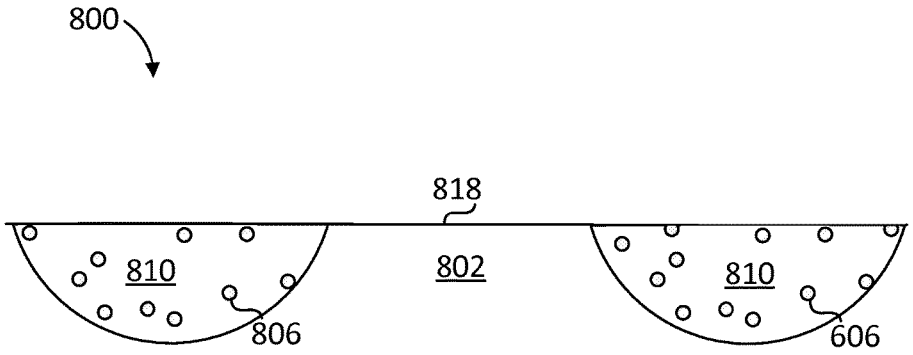
Figure 8F:
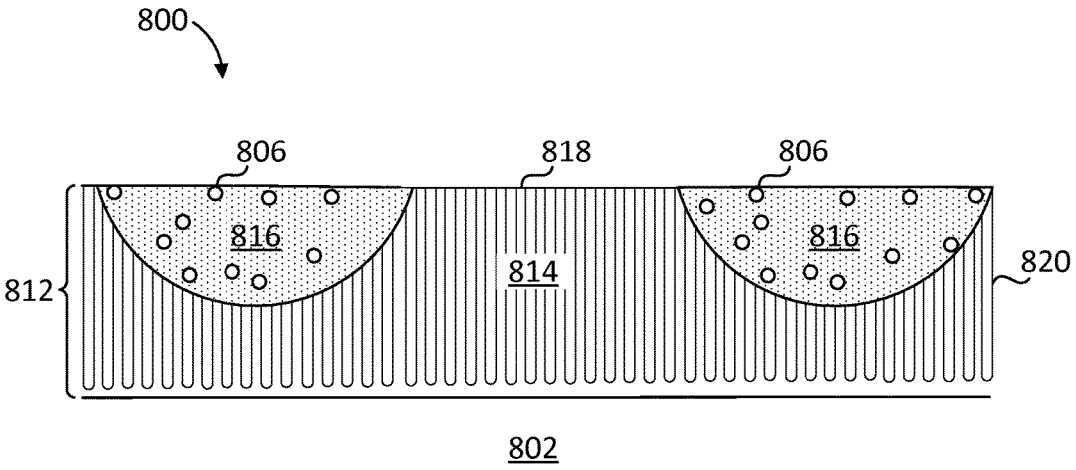

At FIG. 8E, top surface 818 is optionally planarized to remove any surface irregularities due to the melting and re-solidification of re-solidified metal portions 810. In some embodiments, top surface 818 is planarized using a polishing or buffing method. At FIG. 8F, at least a portion of metal substrate 802, including re-solidified metal portions 810, is converted to metal oxide layer 812. In some embodiments, metal oxide layer 812 is formed using an anodizing process. Metal oxide layer 812 includes first metal oxide portion 814 and second metal oxide portion 816. First metal oxide portion 814 corresponds to the converted metal substrate 802 unaffected by thermal treatment. Second metal oxide portion 816 corresponds to the converted re-solidified metal portions 810. Since the microstructure of re-solidified metal portions 810 can be different from the microstructure of surrounding substrate 802, the anodic pore structure of first 814 and second 816 metal oxide portions can be different. In some embodiments, anodic pores 820 of first oxide portion 814 are substantially parallel and highly ordered while the anodic pores (not illustrated) of second oxide portion 816 are curved around particles 806, similar to as described above with reference to FIG. 4. In some embodiments, second oxide portion 816 is substantially free of anodic pores. As shown, second metal oxide portions 816 have reflective particles 806 embedded therein, giving second metal oxide portions 816 a white appearance. Reflective particles 806 can scatter visible light incident top surface 818 and impart a white appearance to oxide layer 812. Note that the location of white second metal oxide portions 816 on substrate 802 can be accurately controlled by, e.g., the use of a laser, without the use of a mask. If white second metal oxide portions 816 are close together, the appearance of entire oxide layer 812 will appear white. If second metal oxide portions 816 are clustered together in a pattern such as a logo or writing, those clustered metal oxide portions 816 will appear white while surrounding first metal oxide portion 814 will appear a different color. In some embodiments, first metal oxide portion 814 will be substantially transparent or translucent such that the color of underlying substrate 802 is visible from top surface 818.

FIGS. 9A-9E illustrate another method for thermally infusing reflective particles within portions of a substrate. At FIG. 9A, a laser beam is directed to a surface of substrate 902 melting or partially melting first portion 908*a*. In addition, dispenser 904 dispenses reflective particles 906 onto melted first portion 908*a*. Particles 906 can be dispensed before, at the same time, or shortly after first portion 908*a* is melted by the laser beam. Particles 906 then become mixed with the liquid or partial liquid metal of melted portion 908*a*. At FIG. 9B, the laser beam is moved to a second portion 908*b* of substrate 902 and dispenser 904 dispensed particles 906 onto melted second portion 908*b*. Particles 906 are then mixed in melted second portion 908*b*, similar to first portion 908*a*. At FIG. 9C, first and second portions 908*a* and 908*b* are allowed to re-solidify forming re-solidified metal portions 910 with particles 906 embedded therein. As with the re-solidified metal portions 810 described above with respect to FIG. 8D, re-solidified metal portions 910 can have a different microstructure than surrounding substrate 902.

Figure 9A:
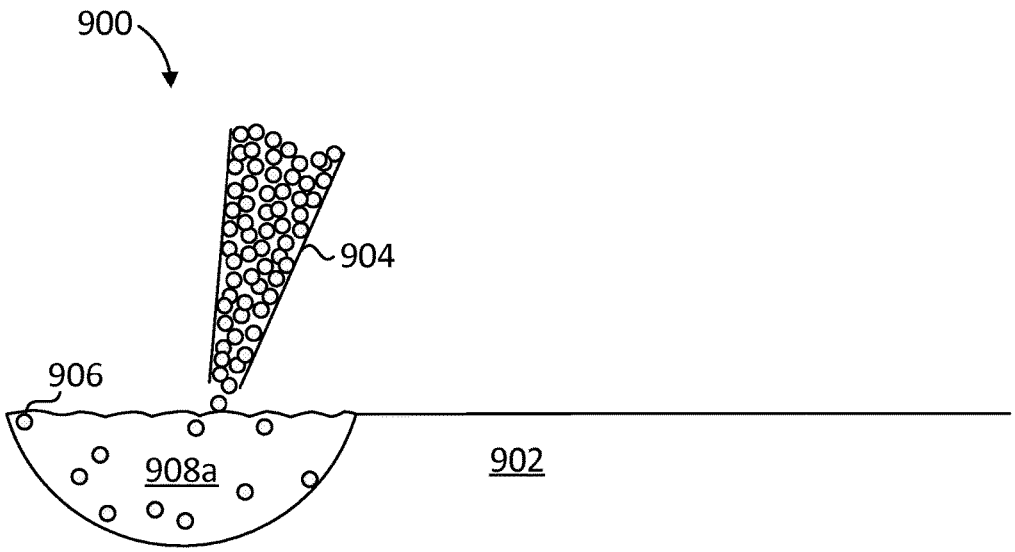
FIGS. 9A-9E shows cross-sectional views of another part undergoing a different thermal infusion procedure followed by an anodizing process.
Figure 9B:
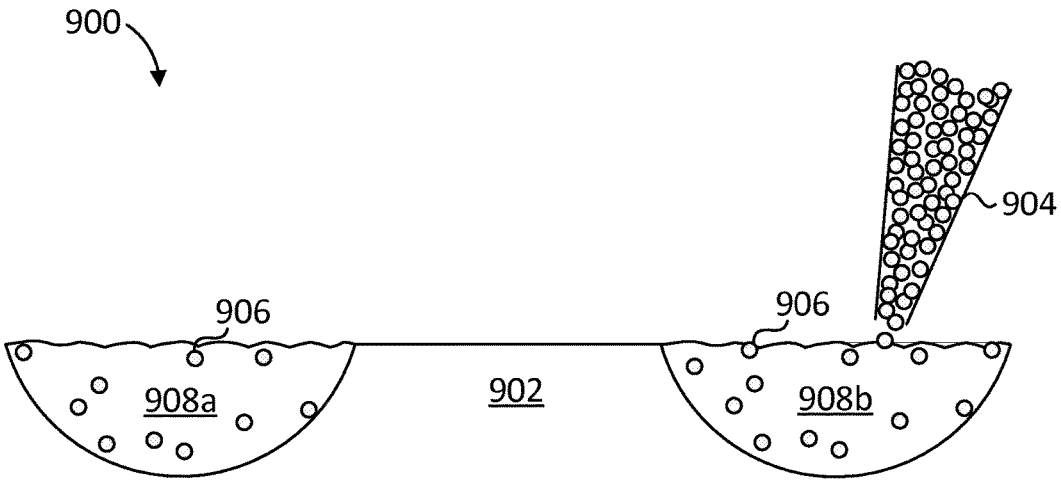
Figure 9C:
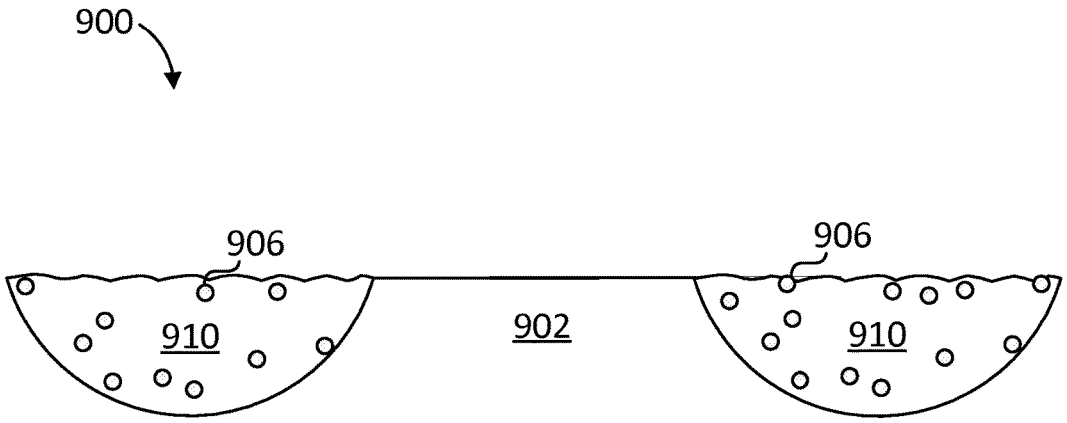
Figure 9D:
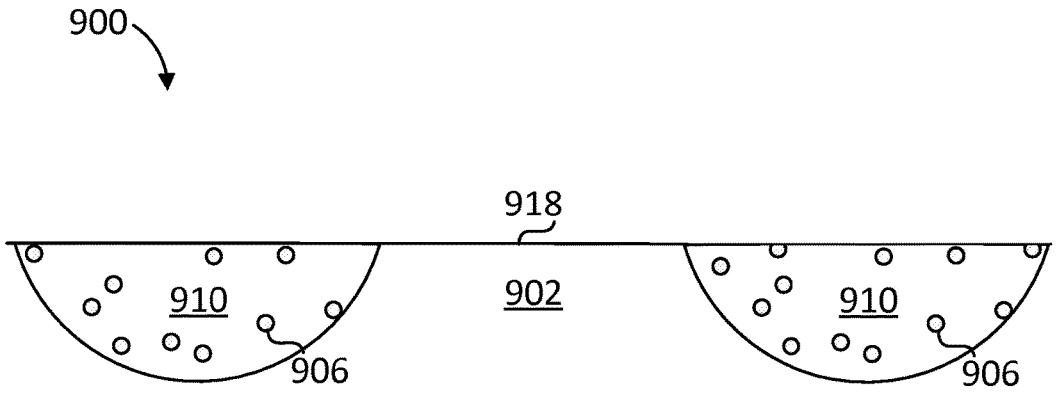
Figure 9E:
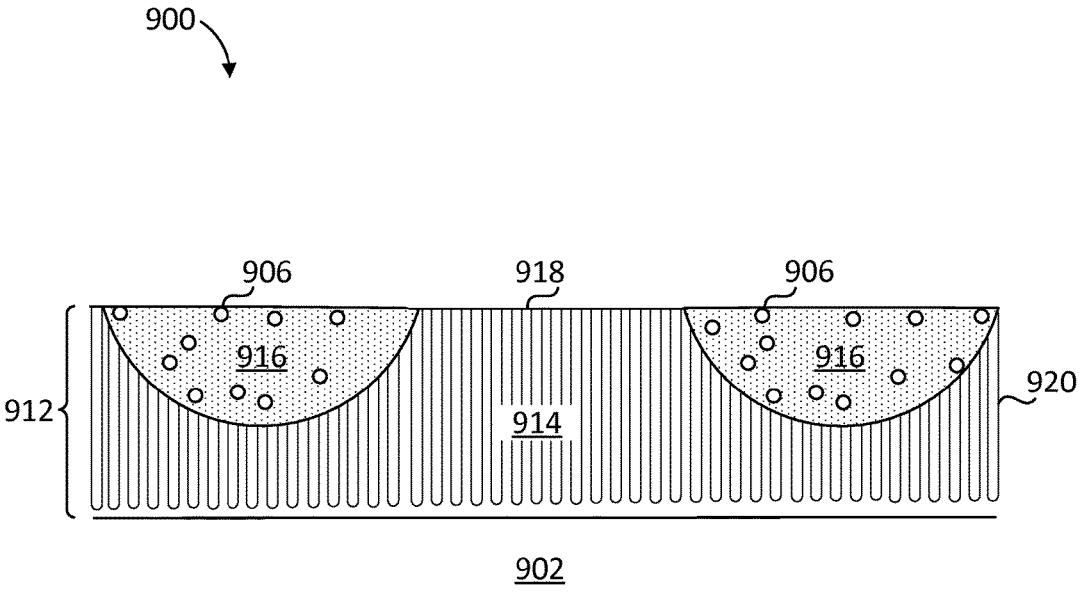

At FIG. 9D, top surface 918 is optionally planarized to remove any surface irregularities due to the melting and re-solidification of re-solidified metal portions 910. At FIG. 9E, at least a portion of metal substrate 902, including re-solidified metal portions 910, is converted to metal oxide layer 912. Metal oxide layer 912 includes first metal oxide portion 914 and second metal oxide portion 916. Since the microstructure of re-solidified metal portions 910 can be different from the microstructure of surrounding substrate 902, the anodic pore structure of first 914 and second 916 metal oxide portions can be different. In some embodiments, anodic pores 920 of first oxide portion 914 are substantially parallel and highly ordered while the anodic pores (not illustrated) of second oxide portion 916 curve around particles 906. In some embodiments, second oxide portion 916 is substantially free of anodic pores. Reflective particles 906 can scatter visible light incident top surface 918 and impart a white appearance to oxide layer 912.

Figure 10:
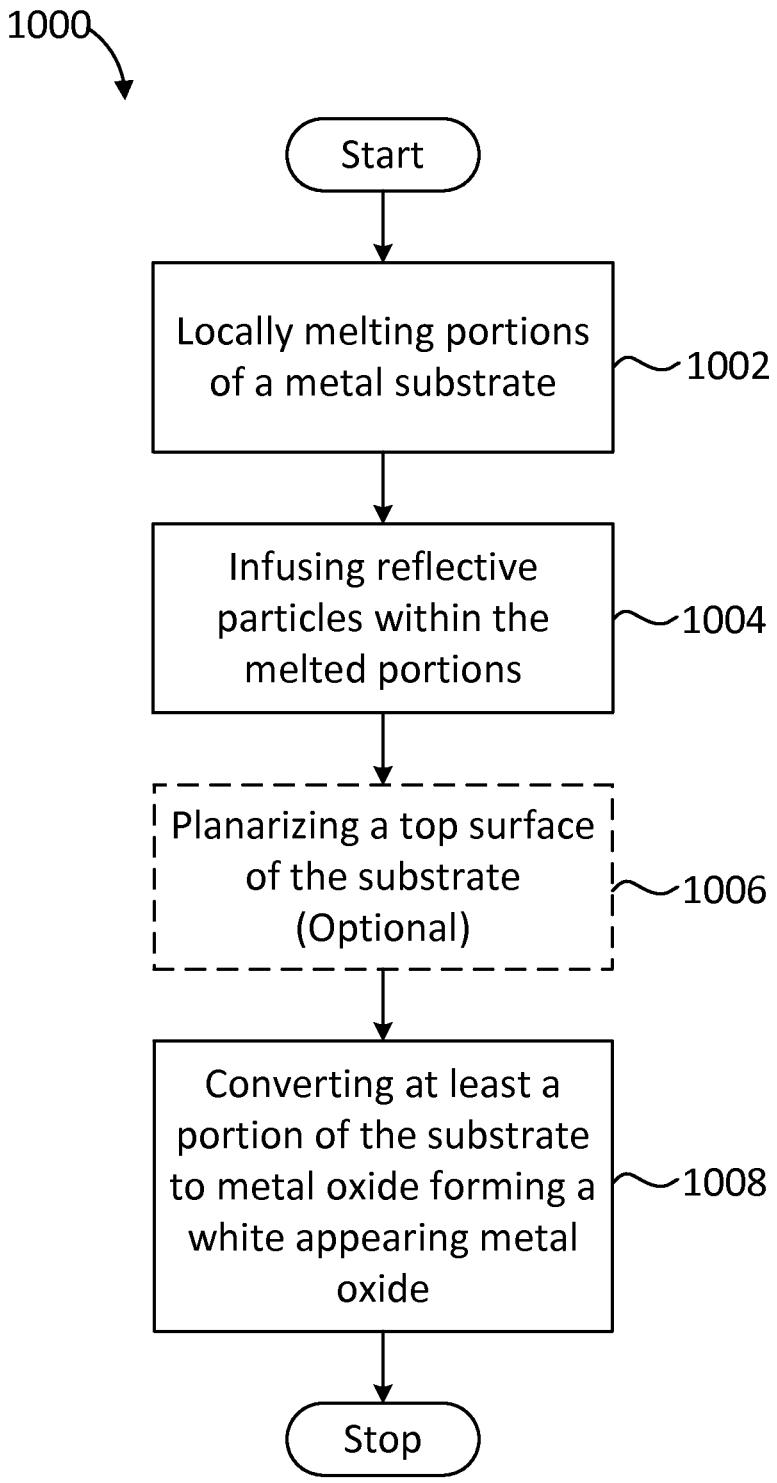
FIG. 10 shows a flowchart indicating steps involved in forming a white metal oxide film on a substrate involving a thermal infusion process as described with reference to FIGS. 8A-8F and 9A-9E.

FIG. 10 shows flowchart 1000 indicating steps involved in forming a white metal oxide film on a substrate using a thermal infusion process prior to anodizing. At 1002, portions of the metal substrate are melted. In some embodiments, the melted portions are arranged in a pattern or design on the substrate. In some embodiments, the melting is accomplished using a laser beam directed at a top surface of the substrate. In some embodiments, the melting is accomplished using a thermal spray method. At 1004, reflective particles are infused within the melted portions of the substrate. In some embodiments, the particles are dispersed in a solution that is spread on the top surface and that mix in with the liquid metal of the melted portions. In some embodiments, the particles are dispensed from a dispenser on the melted portions and that get mixed in with the liquid metal of the melted portions. At 1006, a top surface of the substrate is optionally planarized to remove surface irregularities caused by the melting and infusing processes. In some embodiments, planarizing is accomplished by polishing (mechanical or chemical) the top surface. At 1008, at least a portion of the metal substrate is converted to metal oxide, forming a white appearing metal oxide. In some embodiments, the conversion is accomplished using an anodizing process. In some embodiments, the entire metal oxide layer appears white as viewed from the top surface. In other embodiments, portions of the metal oxide layer appear white while other portions of the metal oxide layer do not appear white, as view from the top surface.

Blasting of Reflective Particles

Figure 11A:
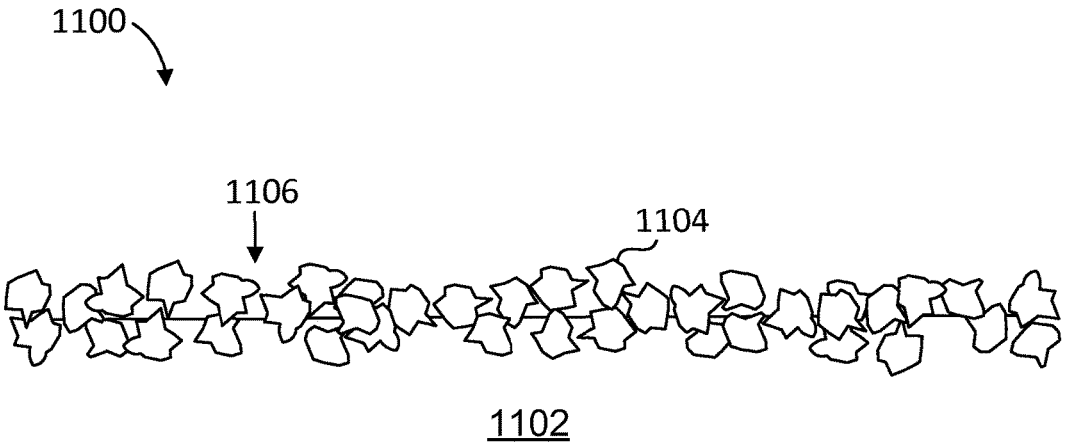
FIGS. 11A-11C show cross-section views of a part undergoing a blasting process.
Figure 11B:
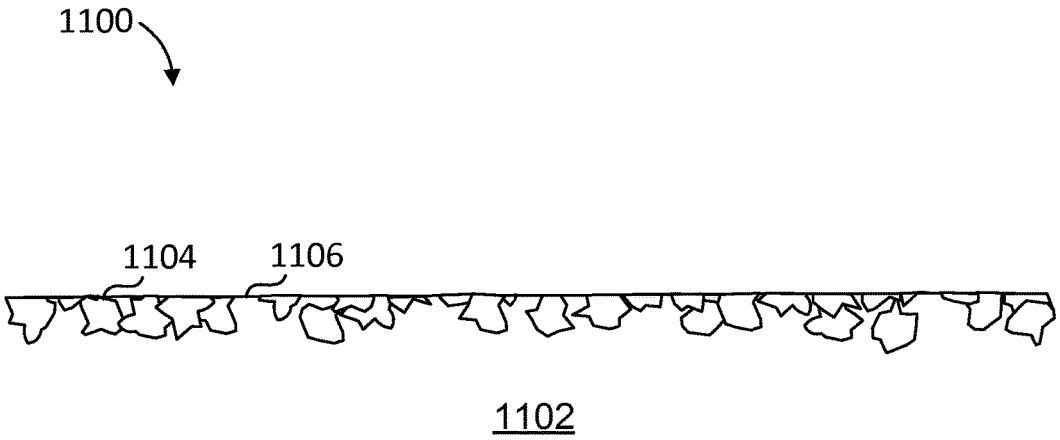
Figure 11C:
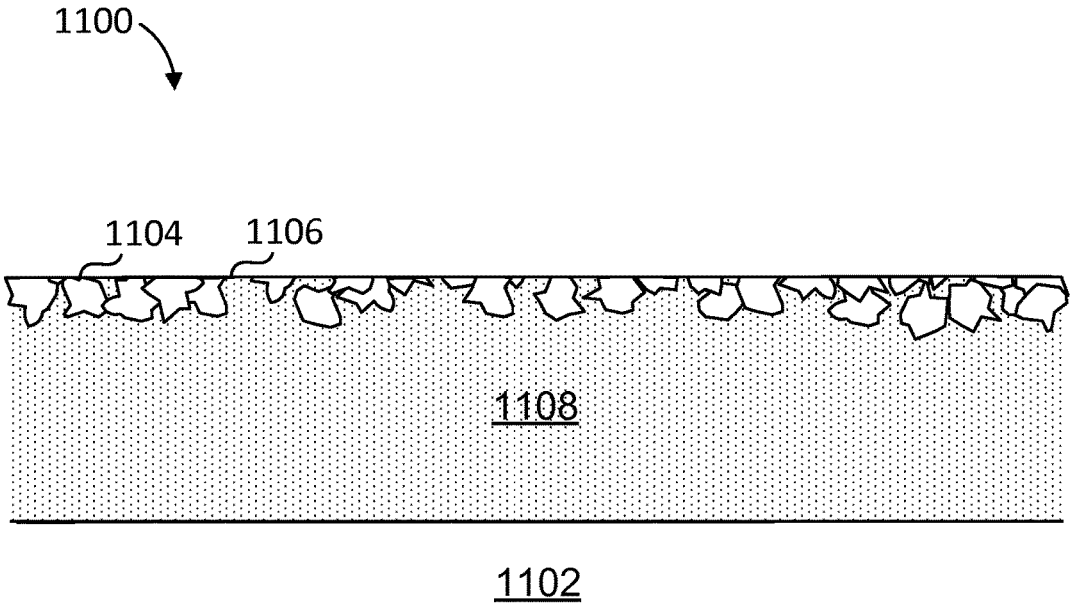

An additional method for positioning reflective particles within a substrate prior to anodizing involves blasting reflective particles onto a surface of a substrate prior to anodizing. FIGS. 11A-11C show cross-section views of part 1100 undergoing a blasting process and an anodizing process in accordance with described embodiments. At 11A, particles 1104 are propelled toward top surface 1106 of substrate 1102 at high pressures. The high pressure causes at least a portion of particles 1104 to become embedded within top surface 1106. In a typical blasting operation, a blasting media is used only to form a textured surface on a substrate. In the embodiments described herein, a blasting process is used to embed reflective particles onto the surface of the substrate. In some embodiments, the blasting nozzle that propels particles 1104 is positioned close to surface 1106 to increase the amount of particles 1104 that become embedded. In some embodiments, particles 1104 have irregular or jagged shapes to increase the likelihood for particles 1104 to become embedded onto surface 1106. In some embodiments, portions of surface 1106 are masked prior to the blasting process in order to create patterns or designs on surface 1106.

At FIG. 11B, surface 1106 is optionally partially cleaned to remove a portion of particles 1104 from surface 1106. In a typical blasting operation, the surface is fully cleaned and polished to remove all of the blasting media and smoothed the surface prior to further processing. The cleaning typically includes desmutting and degreasing process. The polishing process typically involves a chemical polishing process. In the embodiments presented herein, surface 1106 is partially cleaned or not cleaned at all prior to subsequent processing such that particles 1104 remain embedded within substrate 1102. In one embodiment, reduced desmutting and degreasing processes are used, whereby the exposure of substrate 1102 to the desmutting and degreasing solutions are reduced. In some embodiments, no chemical polishing process is used. In some embodiments, the material of particles 1104 is chosen for their resistance to dissolving during desmutting, degreasing and/or chemical polishing processes in addition to being chosen for light scattering ability. In some embodiments, particles 1104 are made of metal. At FIG. 11C, at least a portion of substrate 1102 is converted to metal oxide layer 1108. In some embodiments, metal oxide layer 1108 is formed using an anodizing process. As shown, particles 1104 are situated primarily within the upper portion of oxide layer 1108 near top surface 1106. During an anodizing process, the anodic pores within oxide layer 1108 can grow around particles 1104 such that particles 1104 are positioned outside of the pores, similar to the anodic pores described above with reference to FIG. 4.

Figure 12:
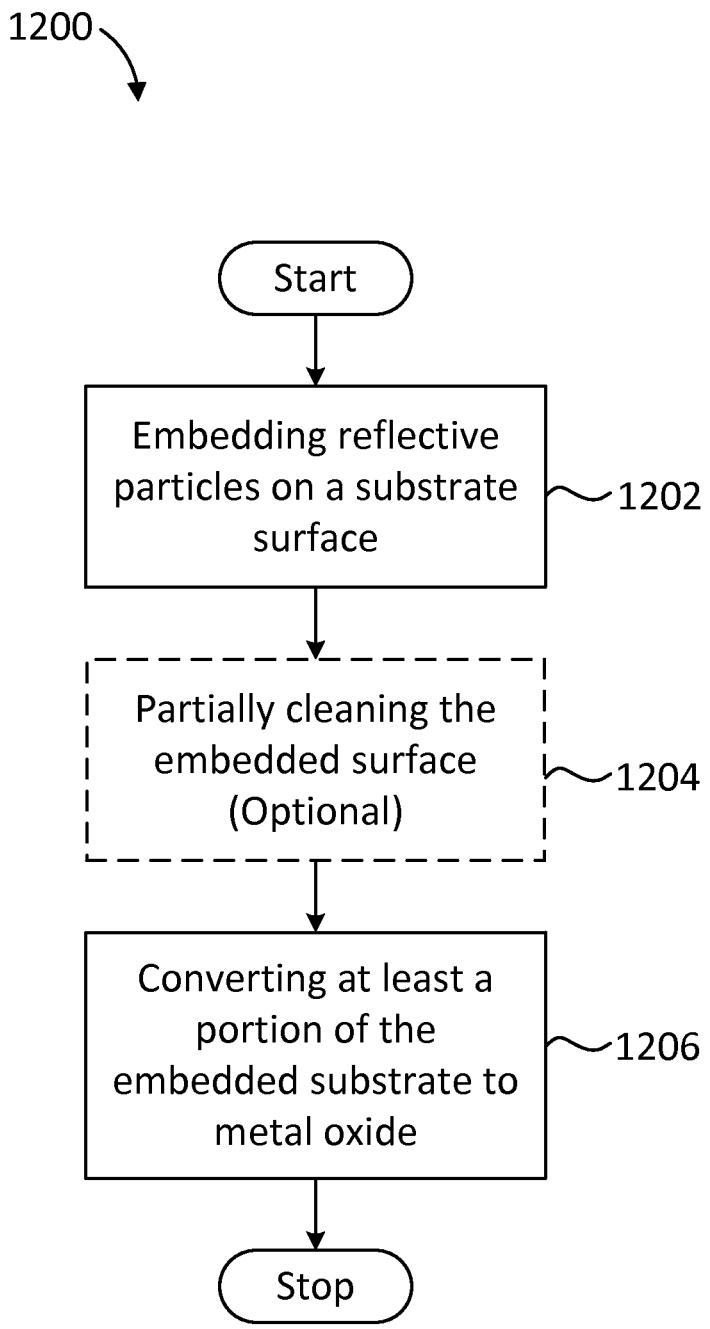
FIG. 12 shows a flowchart indicating steps involved in forming a white metal oxide film using a substrate blasting process as described with reference to FIGS. 11A-11C.

FIG. 12 shows flowchart 1200 indicating steps involved in forming a white metal oxide film using a substrate blasting process prior to anodizing. At 1202, reflective particles are embedded onto a surface of a substrate. In some embodiments, a blasting process whereby reflective particles are propelled toward the substrate surface is used. At 1204, the substrate surface with embedded particles is optionally partially cleaned and/or smoothened. At 1206, at least a portion of the embedded substrate is converted to metal oxide. In some embodiments, an anodizing process is used. The resultant metal oxide film has a white appearance due to the scattering of incident light by the reflective particles.

As described above, some methods described herein involve forming a composite metal material prior to an anodizing process. The composite metal material is bulk material that contains reflective particles within a metal base. Methods can include, but are not limited to, powder metallurgy, infiltration of a porous preform, and casting metal with particles dispersed therein. Some of these methods will be described in detail below with reference to FIGS. 13-16.

Powder Metallurgy

Figure 13A:
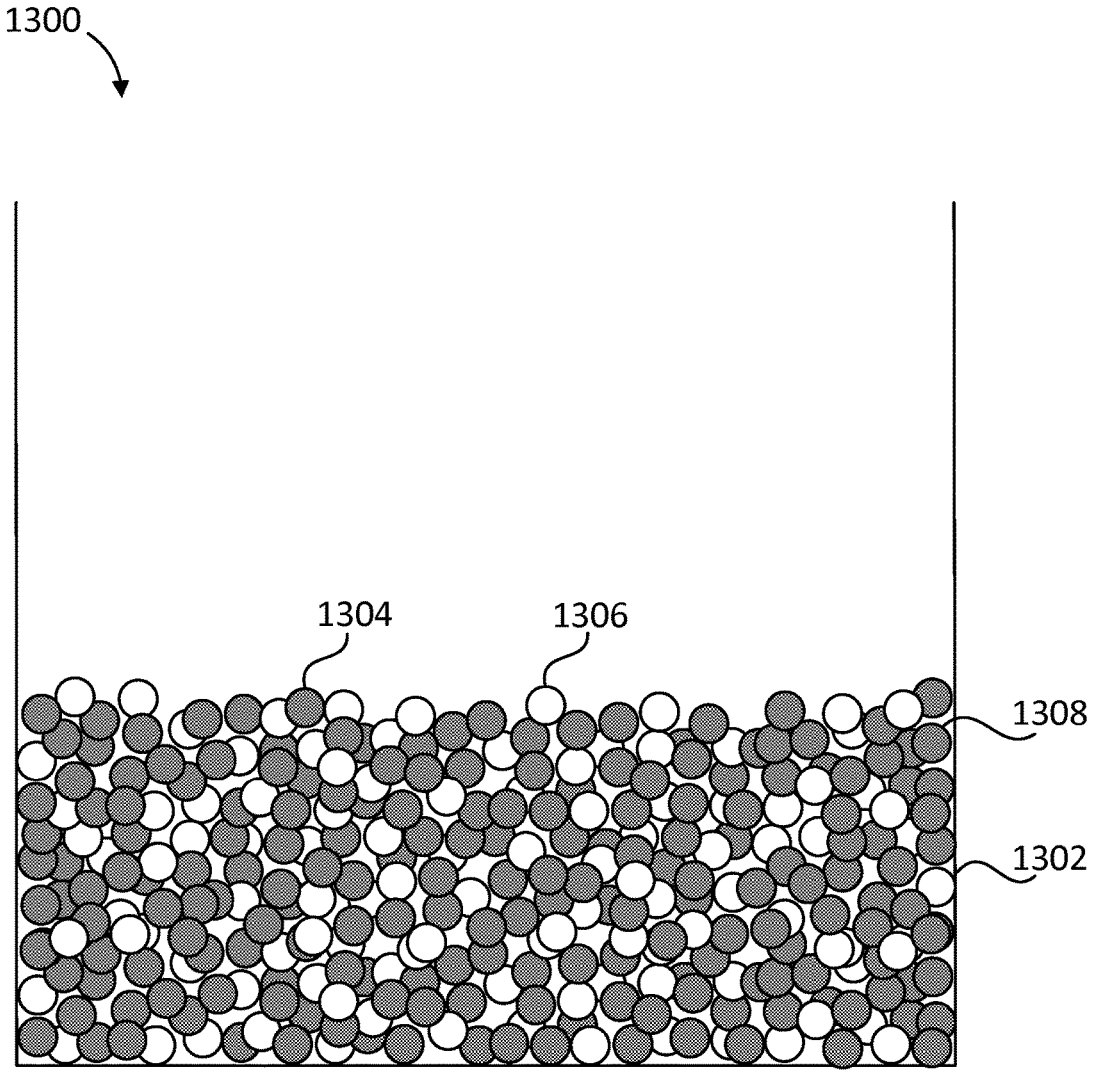
FIGS. 13A-13C show cross-section views of a part undergoing formation of a composite metal layer involving a powder metallurgy process.
Figure 13B:
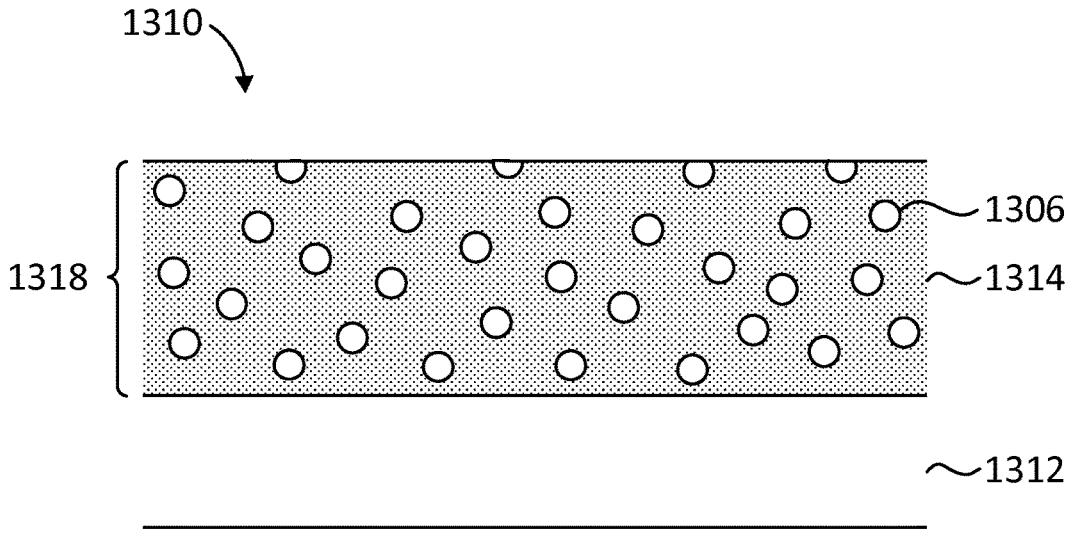
Figure 13C:
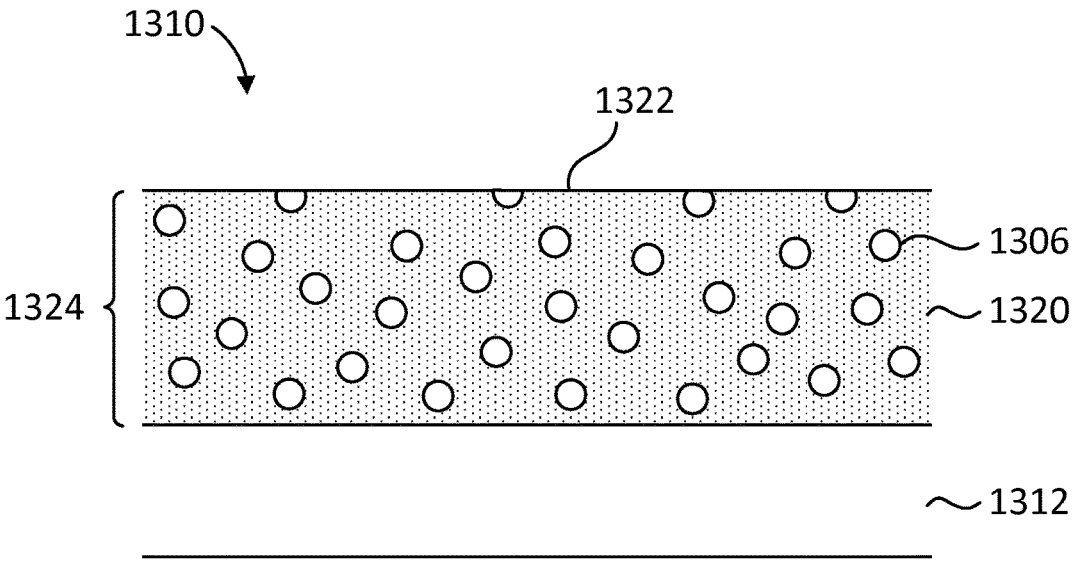

One method of forming a composite metal material involves blending and pressing of reflective particles and metal particles onto a surface of a substrate prior to anodizing. The blending of powdered materials and pressing them into a desired shape is sometimes referred to as powder metallurgy. In the embodiments described herein, reflective particles are mixed in with metal particles and pressed together under high pressure forming a composite metal layer. FIGS. 13A-13C show cross-section views of part 1310 undergoing formation of a composite metal layer using powder metallurgy followed by anodizing. FIG. 13A shows a mixing system 1300, which includes mixing container 1302. Composite material mixture 1308, which includes reflective particles 1306 and metal particles 1304, is placed in container 1302 and mixed. Mixing system 1300 can include a mixing apparatus (not shown) that can agitate composite material mixture 1308 to keep that reflective particles 1306 are substantially evenly distributed amongst metal particles 1304. In some embodiments, container 1302 is rotated or vibrated to mix particles 1304 and 1306. In some embodiments, a stirring apparatus is placed in container 1302 to mix particles 1304 and 1306. After particles 1304 and 1306 are sufficiently blended, composite material mixture 1308 can be compressed into a layer onto a substrate.

FIG. 13B shows part 1310, which includes composite mixture 1308 after it has been compressed into composite metal layer 1318 onto substrate 1312. During the compression process, metal particles 1304 are fused together forming a continuous matrix of metal 1314. Reflective particles 1306 remain intact during the compression process and become lodge within metal matrix 1314. The compression process can include any suitable process that causes substantially all of metal particles 1304 to compress and fuse together. In some embodiments, reflective particles 1306 are left substantially intact and substantially unchanged in shape during the compressing. In some embodiments, a hot isostatic pressing process is used. During a hot isostatic pressing process, composite material mixture 1308 can be placed on substrate 1312 and part 1310 is subjected to an elevated temperature and an elevated isostatic gas pressure. Under the elevated temperature and pressure, metal particles 1304 fuse together into a continuous metal matrix 1314 with reflective particles 1306 embedded therein. In some embodiments, a cold spraying process is used, whereby composite mixture 1308 is shot at the surface of substrate 1312 at a high enough pressure that metal particles 1304 deform upon impact and fuse together. As shown, reflective particles 1306 are distributed throughout composite metal layer 1318, not just on the surface. Since composite metal layer 1318 is formed on substrate 1312 using a compression process, substrate 1312 is not limited to electrically conductive materials. Substrate 1312 can be made of plastic, ceramic, or non-conductive metals. In some embodiments, substrate 1312 is made of a conductive material or a combination of conductive material and non-conductive material.

At FIG. 13C, metal matrix 1314 of composite metal layer 1318 is converted to metal oxide 1320. Reflective particles 1306 remain substantially intact and in place during the conversion process. In some embodiments, an anodizing process is used to convert metal 1314 to metal oxide 1320. Since reflective particles 1306 are in place during anodizing, the pores of the anodic film can grow around particles 1306, such as described above with reference to FIG. 4. As described above, the material, average size, shape, and amount of reflective particles 1306 can be chosen such that the resultant oxide layer 1324 has a white appearance as viewed from top surface 1322.

Infiltration of Porous Preform of Reflective Particles

Another method for forming a composite metal material involves infiltrating a porous preform of reflective particles with liquid metal (e.g., aluminum). In one embodiment, the porous preform of reflective particles is made by mixing reflective particles with a binder material to form a binder complex. The binder complex is then be compressed until the reflective particles bind together. The binder material is then removed, leaving the porous preform of reflective particles. In another embodiment, the porous preform of reflective particles is made by compacting the reflective particles together without binder material.

FIGS. 14A-14D show cross-section views of part 1400 undergoing positioning of reflective particles within a metal oxide film that includes forming a porous preform of reflective particles. At FIG. 14A, binder complex layer 1408 is formed using any suitable method. Binder complex layer 1408 includes binder material 1404 and reflective particles 1406, which are dispersed within binder material 1404. Reflective particles 1406 can be mixed within binder material 1404, and then the mixture can be compressed together. In some embodiments, binder complex layer 1408 is compressed within a mold (not shown) that provides a general shape to binder complex layer 1408. In some embodiments, binder complex layer 1408 is compressed onto a separate substrate (not shown). Binder material 1404 can be made of any of a number of suitable materials that can be removed during a subsequent binder material 1404 removal process. Suitable types of binder material 1404 can include wax (e.g. paraffin wax), various polymers, and organic compounds. In some embodiments, reflective particles 1406 remain substantially intact during the pressing process. The pressing process can compact binder complex layer 1408 with sufficient pressure to force adjacent reflective particles 1406 to adhere with one another.

Figure 14A:
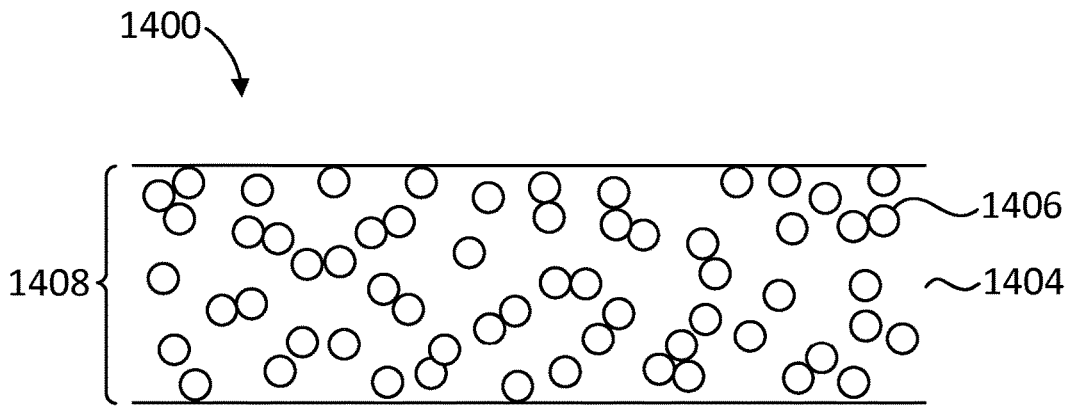
FIGS. 14A-14D show cross-section views of a part undergoing formation of a composite metal layer involving formation of a porous preform of reflective particles.
Figure 14B:
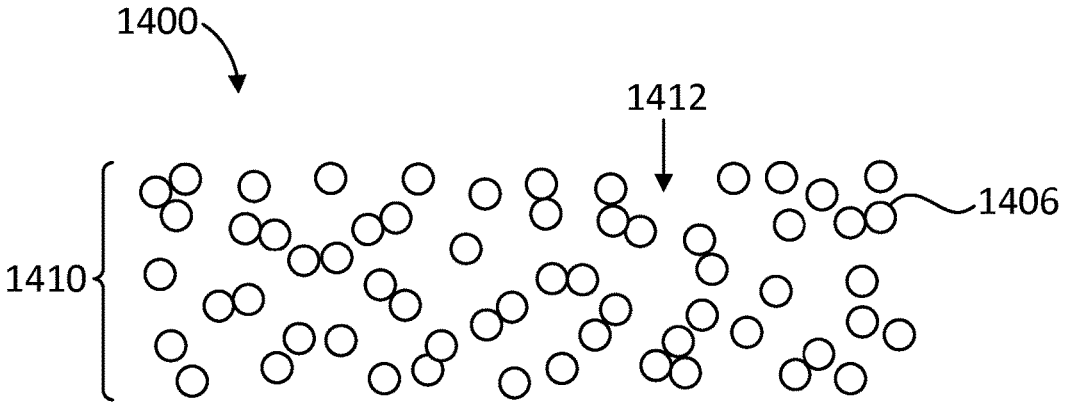

FIG. 14B shows part 1400 after a binder material 1404 removal process, leaving porous preform 1410. Binder material 1404 can be removed using any suitable method, such as by sublimation, liquefaction followed by drainage, or liquefaction followed by vaporization. In some embodiments, removal of binder material 1404 involves heating part 1400 until binder complex layer 1408 "burns off" into gaseous form. In some embodiments, heating causes binder material 1404 to first liquefy and then vaporize, i.e., "burn off" In some embodiments, once in liquid form, binder material 1404 can be drained off of porous preform 1410. In some embodiments, the binder material removal process leaves substantially no trace of binder material 1404 within porous preform 1410. Heating can occur, for example, by placing part 1400 in a furnace. In some embodiments, binder material 1404 is heated to a temperature high enough for removal of binder material 1404 but lower than the melting temperature of reflective particles 1406. Once binder material 1404 is removed, voids 1412 remain within porous preform 1410 where binder material 1404 once was. In this way, porous preform 1410 is a porous structure made of adhered together reflective particles 1406. Note that in some embodiments, porous preform 1410 is made without the aid of binder material 1404. That is, reflective particles 1406 can be compressed together with sufficient pressure to force adjacent reflective particles 1406 to adhere with one another without the aid of binder material 1404.

Figure 14C:
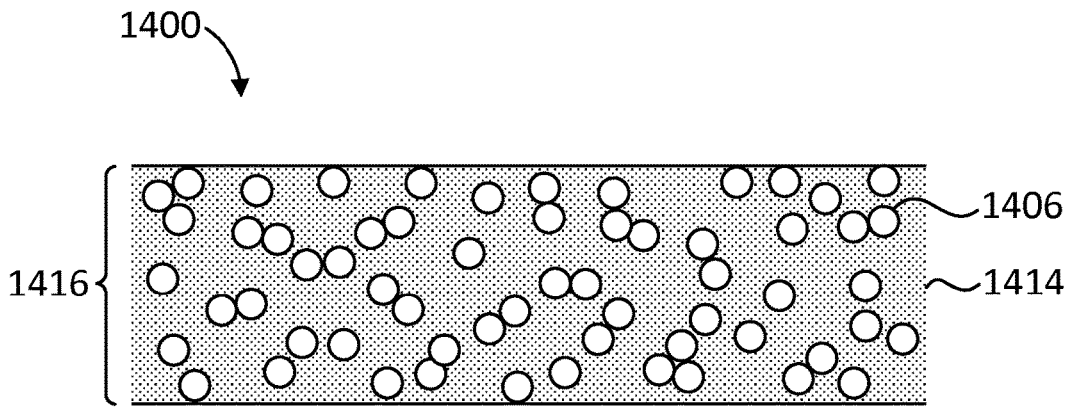
Figure 14D:
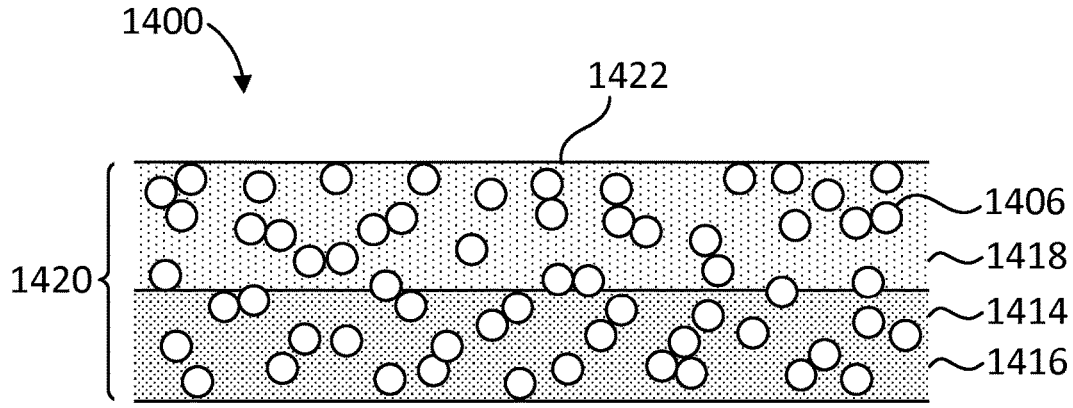

FIG. 14C shows part 1400 after a metal infiltration process. During the metal infiltration process, metal 1414 in molten form can be poured onto porous preform 1410 and within voids 1412. Reflective particles 1406 can remain substantially in place within porous preform 1410 during the metal infiltration process such that reflective particles 1406 are dispersed within metal 1414. In some cases, part 1400 is placed under vacuum conditions to decrease the pressure within voids 1412, thereby forcing the molten metal 1414 to completely fill voids 1412. In some embodiments, porous preform 1410 is placed within a mold (not shown) prior to the infusion of metal 1414 to give composite metal layer a particular shape. Metal 1414 is then allowed to cool and solidify, forming composite metal layer 1416. At FIG. 14D, a portion of metal 1414 of composite metal layer 1416 is converted to metal oxide layer 1418, using, for example, an anodizing process. In some embodiments, substantially all of metal 1414 is converted to metal oxide layer 1418. Reflective particles 1406 remain substantially intact and in place during the conversion process. Since reflective particles 1406 are in place during anodizing, the pores within metal oxide layer 1418 can grow around particles 1406, such as described above with reference to FIG. 4. As described above, the material, average size, shape, and amount of reflective particles 1406 can be chosen such that oxide layer 1420 has a white appearance as viewed from top surface 1422.

Casting of Metal with Dispersed Reflective Particles

Figure 15A:
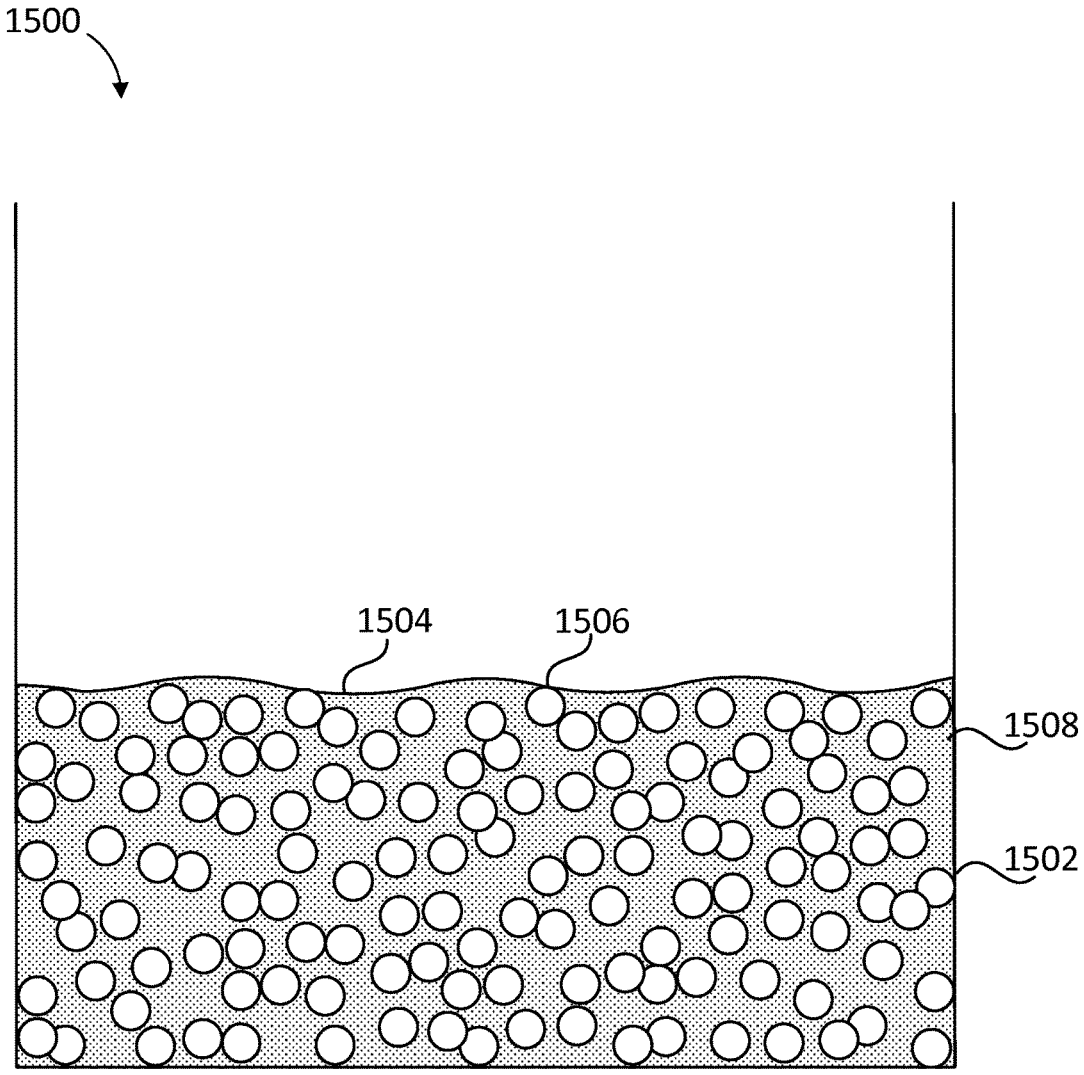
FIGS. 15A-15D show cross-section views of a part undergoing formation of a composite metal layer involving a casting process.

A further method of forming a composite metal material involves casting of metal that has reflective particles dispersed therein. FIGS. 15A-15D show cross-section views of part 1500 undergoing a casting process in accordance with some embodiments. FIG. 15A shows crucible 1502 that is configured to hold melted metal 1504. Reflective particles 1506 are added to and mixed with melted metal 1504 to form composite material mixture 1508. Reflective particles 1506 can be mixed within melted metal 1504 using any suitable means, including slowly adding while folding in reflective particles 1506 or mixing melted metal 1504 using a tool such as a rod. In some embodiments, the mixing is continued until reflective particles 1506 are substantially evenly dispersed within melted metal 1504.

Figure 15B:
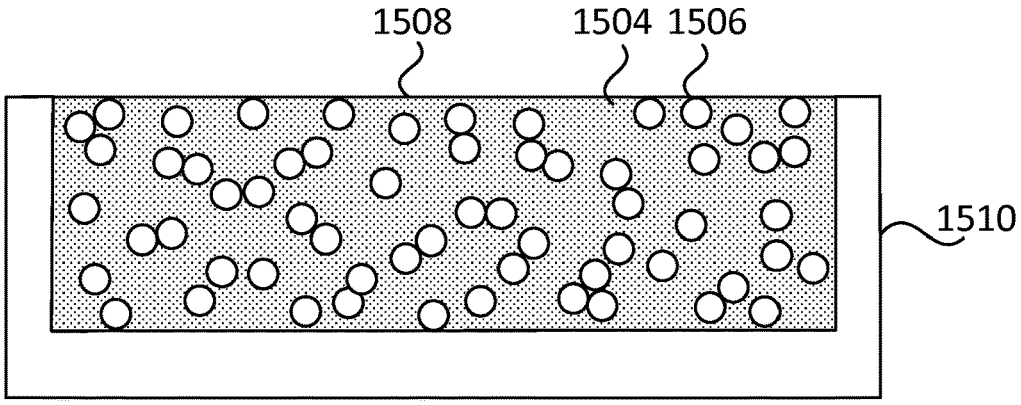

At FIG. 15B, composite metal mixture 1508, while in liquid form, is poured into mold 1510. Mold 1510 can be any suitable type of mold, including a sand casting mold or die-casting mold. Mold 1510 can have any suitable shape for providing a final shape to composite metal mixture 1508. In some embodiments, mold 1510 has a shape that corresponds to giving composite metal mixture 1508 a shape of an enclosure for an electronic device. In some embodiments, pressure is applied to composite metal mixture 1508 while in mold 1510 to remove air bubbles within composite metal mixture 1508. In some cases, composite metal mixture 1508 is placed under vacuum conditions to remove air bubbles within composite metal mixture 1508. In some embodiments, some reflective particles 1506 are added to liquid metal 1504 during the molding process. That is, some or all of reflective particles 1506 are placed within mold 1510 prior to pouring in liquid metal 1504.

Figure 15C:
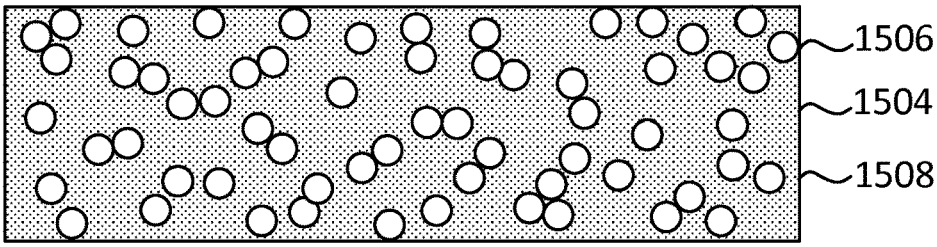
Figure 15D:
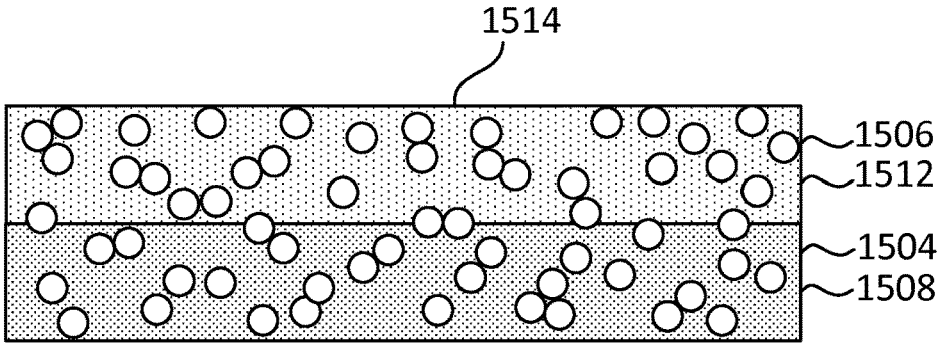

At FIG. 15C, composite metal mixture 1508 is allowed to cool and solidify and is removed from mold 1510. Solidified composite metal mixture 1508 retains a shape in accordance with the shape of mold 1510. At FIG. 15D, a portion of metal 1504 of composite metal mixture 1508 is converted to metal oxide layer 1512. In some embodiments, substantially all of metal 1504 is converted to metal oxide layer 1512. Reflective particles 1506 can remain substantially intact and in place during the conversion process. In some embodiments, an anodizing process is used to convert metal 1504 to metal oxide layer 1512. Since reflective particles 1506 are in place during anodizing, the pores of metal oxide layer 1512 can grow around particles 1506, such as described above with reference to FIG. 4. As described above, the material, average size, shape, and amount of reflective particles 1506 can be chosen such that the resultant oxide layer 1512 has a white appearance as viewed from top surface 1514.

Figure 16:
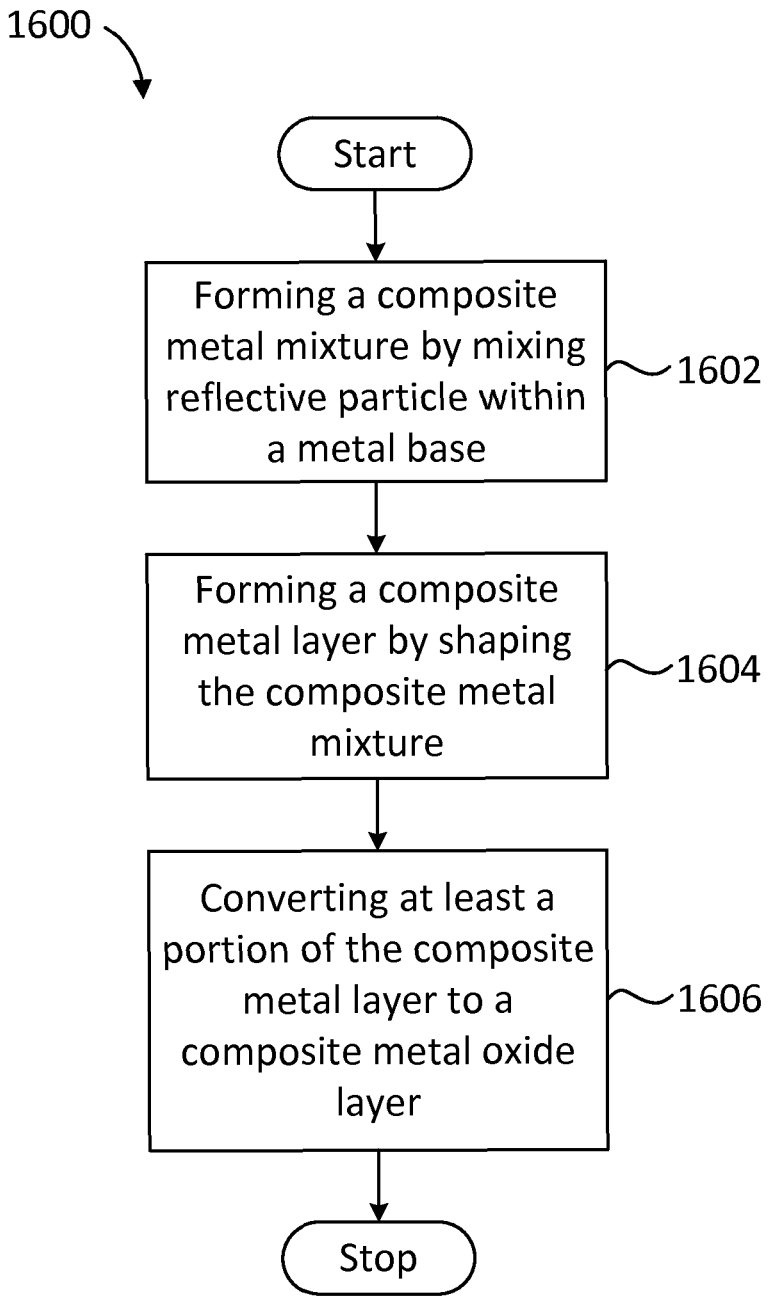
FIG. 16 shows a flowchart indicating steps for forming a white appearing metal oxide film involving the formation of a composite material described with reference to FIGS. 13A-13C, 14A-14D, and 15A-15D.

FIG. 16 shows flowchart 1600 indicating steps for forming a white appearing metal oxide film involving the formation of a composite metal material in accordance with described embodiments. At 1602, a composite metal mixture is formed by mixing reflective particles within a metal base. In some embodiments, the composite metal mixture is formed using a power metallurgic technique, whereby reflective particles are mixed with metal particles. In some embodiments, the composite metal mixture is formed by forming a porous preform of reflective particles and then infiltrating metal within voids of the porous preform. In some embodiments, the composite metal mixture is formed using a casting technique whereby reflective particles are mixed within a melted metal base. In some embodiments, the volume fraction of reflective particles should be up to about 60% by volume in order to achieve an optimum combination of white cosmetics, mechanical strength, and ductility in a resulting composite metal layer.

At 1604, a composite metal layer is formed by shaping the composite metal mixture. For powder metallurgic methods, the shaping can involve compressing the mixture of reflective particles and metal particles with sufficient force to fuse the metal particles together. In some embodiments, a hot isostatic pressing process is used. In other embodiments, a cold spraying process is used. For porous preform methods, the shaping can be accomplished at the same time that the composite mixture is formed. That is, the shaping can occur while pressing the reflective particles together into a porous preform and infiltrating metal within voids of the porous preform. In some embodiments, the porous preform can be pressed within a mold to create a general shape for the porous preform. In some embodiments, the metal is infiltrated within the pores while the porous preform is positioned on a substrate and/or a mold to give a general shape to the composite metal layer. For casting methods, the shaping can involve pouring the melted metal, which have reflective particles mixed therein, into a mold where it is allowed to solidify and take on a general shape in accordance with a shape of the mold. At 1606, at least a portion of the metal of the composite metal layer is converted to a metal oxide layer. In some embodiment, the conversion is accomplished using an anodizing process. The resultant metal oxide layer has a white appearance due to the scattering of incident light by the reflective particles.

Depositing Particles During Anodizing Process

Figure 17A:
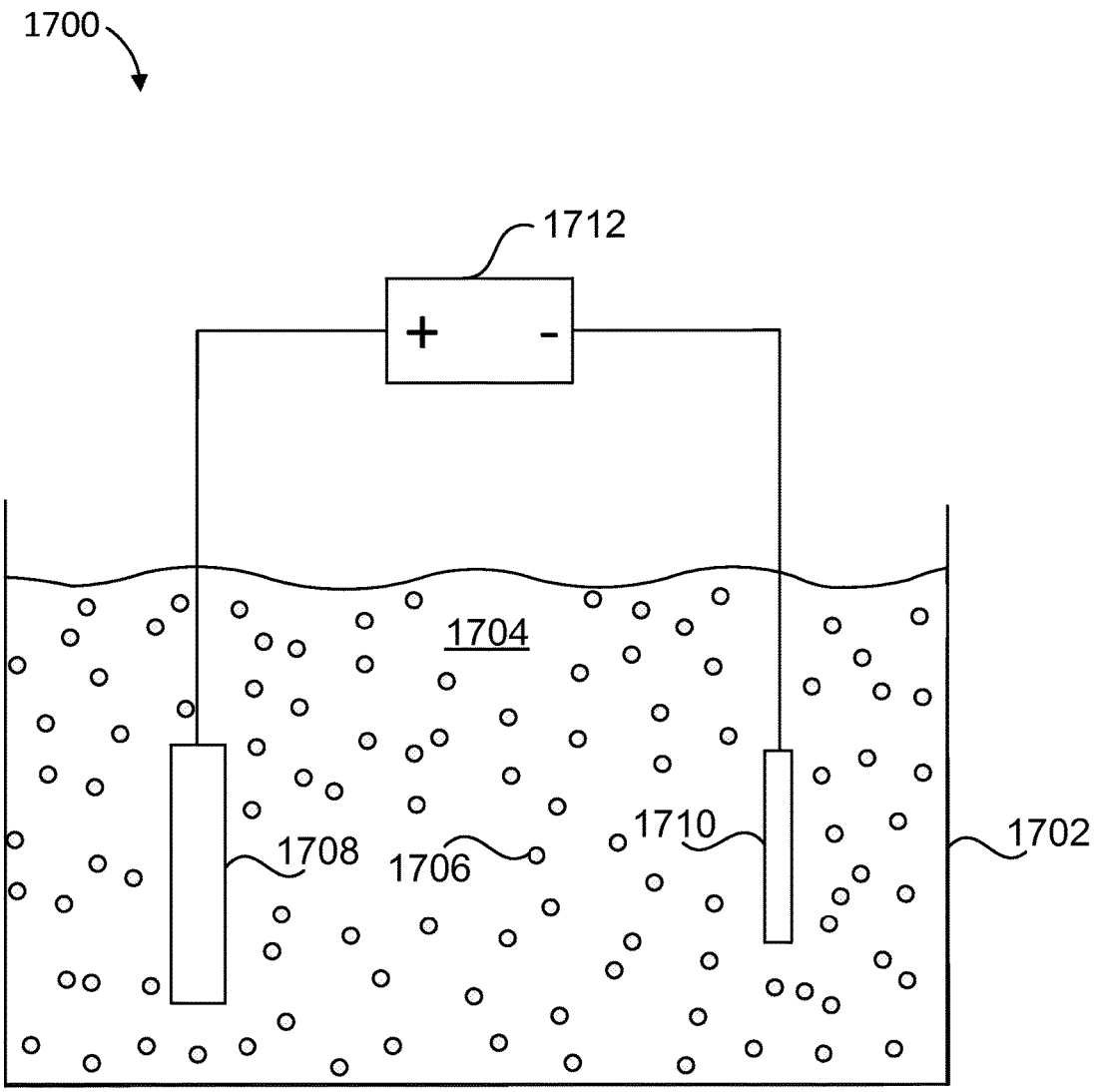
FIG. 17A shows an anodizing cell used to simultaneously form an oxide layer and deposit particles within the oxide layer during an anodizing process.

In some embodiments, forming a white appearing metal oxide layer involves depositing reflective particles within the metal oxide during an anodizing process. FIG. 17A shows anodizing cell 1700 used to deposit particles 1706 within an oxide layer during an anodizing process. Anodizing cell 1700 includes container or tank 1702, which is configured to hold electrolytic bath 1704, anode 1708, and cathode 1710. During an anodizing process, anode 1708 is the part that is anodized. Power supply 1712 applies a voltage across anode part 1708 and cathode 1710. When voltage is applied, electrons are withdrawn from anode part 1708, allowing ions at the surface of part 1708 to react with water in electrolytic bath 1704 and to form an oxide film on part 1708. Electrolytic bath 1704 includes reflective particles 1706, which are negatively charged. In some embodiments, reflective particles 1706 are made of a substance that is negatively charged when placed in electrolytic bath 1704, such as $SiO_2$. In some embodiments, reflective particles 1706 are covered with a coating or sizing that give reflective particles 1706 a negative charge when placed in electrolytic bath 1704. In one embodiment, $TiO_2$ particles are covered with a $SiO_2$ coating to make the $TiO_2$ particles negatively charged. In some embodiments, reflective particles 1706 are covered with a dispersing agent that help disperse and evenly distribute reflective particles 1706 within electrolytic bath 1704 and prevent reflective particles 1706 from agglomerating.

Since reflective particles 1706 are negatively charged, they are attracted to and travel toward anode part 1708 while the oxide film is being formed. Reflective particles 1706 that are at the surface of anode part 1708 during the anodizing process can become embedded within the anodic film. In some embodiments, electrolytic bath 1704 is agitated to keep reflective particles 1706 from settling to the bottom of tank 1702 due to gravity. In some embodiments, electrolytic bath agitated or mixed during the anodizing to keep particles 1706 from settling. In some embodiments, anode part 1708 is positioned near the bottom of tank 1702 such that particles 1706 settle onto anode part 1708 during the anodizing process.

Figure 17B:
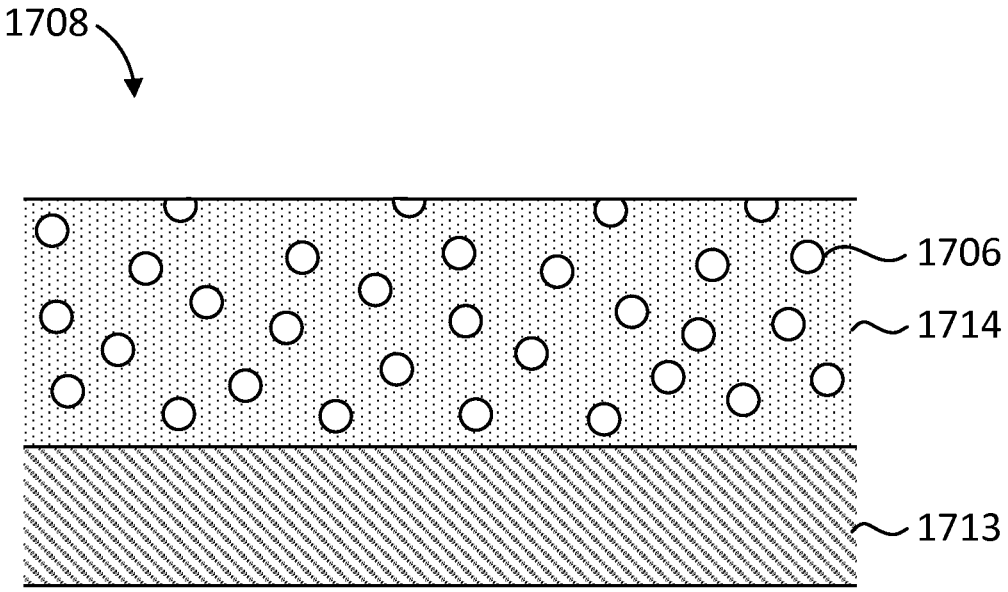
FIG. 17B shows a cross-section view of a part after a simultaneous particle embedding and anodizing process.

FIG. 17B shows a cross-section view of part 1708 after a simultaneous particle embedding and anodizing process. During the anodizing process, at least a portion of 1713 is converted to metal oxide layer 1714. The reflective particles, which are negatively charged, become embedded within metal oxide layer 1714. In some embodiments, particles 1706 are substantially evenly distributed within metal oxide layer 1714. During anodizing, the pores of the anodic film grow around particles 1706, similar to pores 408 described above with reference to FIG. 4.

Figure 18:
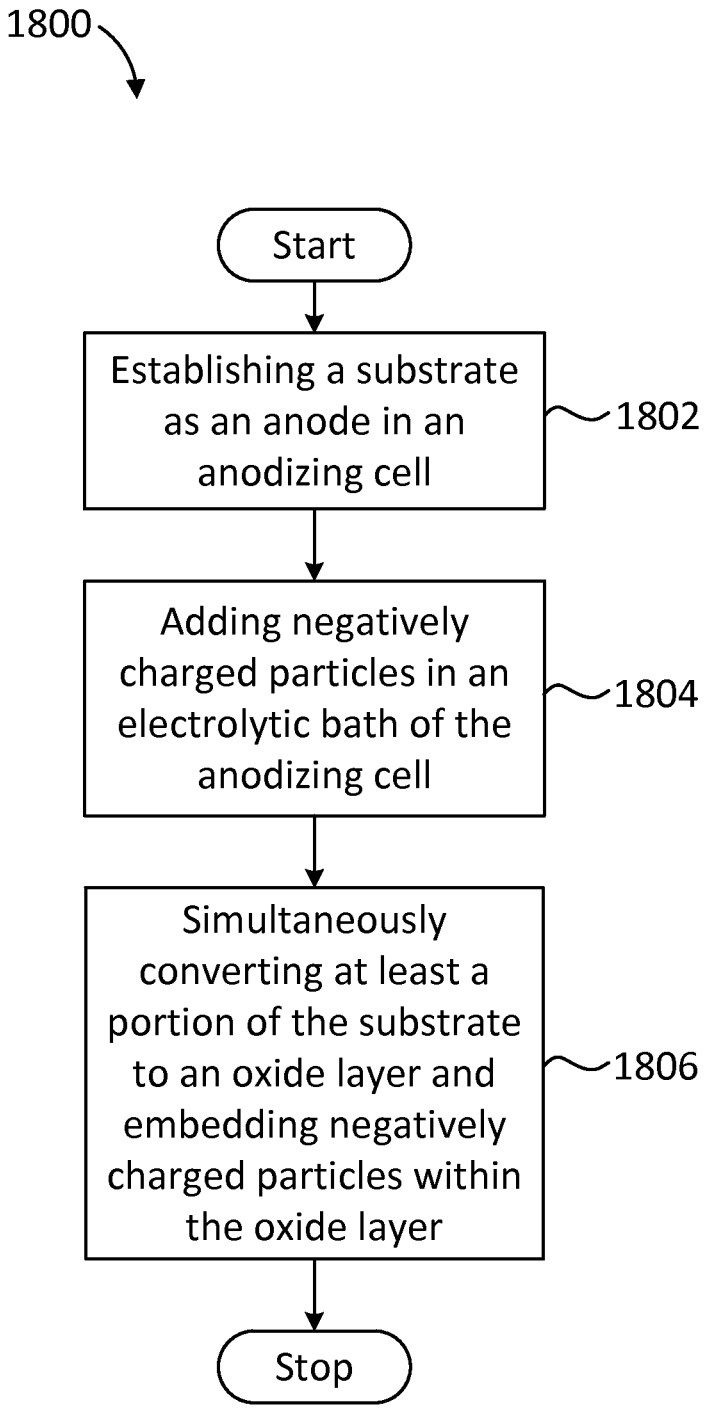
FIG. 18 shows a flowchart indicating steps involved in forming a white metal oxide film using a simultaneous particle embedding and anodizing process.

FIG. 18 shows flowchart 1800 indicating steps involved in forming a white metal oxide film using a simultaneous particle embedding and anodizing process. At 1802, a substrate is established as an anode of an anodizing cell. At 1804, negatively charged particles are added to the electrolytic bath of the anodizing cell. The particles can be chosen for their light scattering ability, as described above. At 1806, at least a portion of the substrate is converted to an oxide layer while negatively charged particles are simultaneously embedded within the oxide layer. The resultant aggregate metal oxide layer scatters incident light and has a white appearance.

It should be noted that relative amount of reflective particles used in composite material methods may differ from methods involving positioning particles within a substrate. For example, in composite metal material methods, higher amounts of reflective particles can generally correlate with stronger and whiter composite material. However, higher amounts of reflective particles can also reduce ductility of the resultant composite material. Therefore, the volume fraction of reflective particles can be optimized for desired strength, whiteness, and ductility. In some applications, a volume fraction of reflective particles up to about 60% is used in order to achieve an optimum combination of white cosmetics, mechanical strength, and ductility in the resulting composite metal layer. For the non-bulk composite metal material methods, which include co-plating metal with reflective particles, thermal infusion of reflective particles, blasting of reflective particles, and depositing of reflective particles during anodizing, a significant amount of the mechanical properties of the metal layer can come from the base metal of the substrate. Thus, it may be necessary in some cases to have as high a volume fraction as possible to increase whiteness. In some applications, a volume fraction of reflective particles around 60% or higher is used in order to achieve an optimum of whiteness of the resulting metal layer.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A part, comprising:

a metal substrate; and a metal oxide layer overlaying the metal substrate, the metal oxide layer including:

an ordered region having substantially parallel pore structures that are arranged in an ordered manner and that extend from a top surface of the metal oxide layer to the metal substrate such that, of an amount of light incident onto an external surface of the metal oxide layer, a portion of the amount of light passes through the substantially parallel pore structures and is reflected from the metal substrate, and reflective melted regions formed around perimeter of the top surface of the metal oxide layer that are separated from each other and from the substrate by the ordered region such that each of the reflective melted regions is equidistant from each other, the reflective melted regions characterized as having a microstructure that is different than the ordered region, wherein the reflective regions include (i) irregularly arranged pore structures, and (ii) reflective particles capable of reflecting light there-from, wherein the reflective regions are separated from each other such that at least a remaining portion of the amount of light incident onto the external surface is reflected from the reflective particles and combines with the amount of light reflected from the metal substrate, thereby imparting a white appearance to the metal oxide layer.

2. The part of claim 1, wherein the reflective particles include a metal oxide material.

3. The part of claim 1, wherein the reflective particles include at least one of titanium oxide, zirconium oxide, zinc oxide or aluminum oxide.

4. The part of claim 1, wherein the reflective particles comprise a metal material.

5. The part of claim 1, wherein the reflective particles comprise at least one of aluminum, steel or chromium.

6. The part of claim 1, wherein the reflective melted regions are without dyed particles.

7. The part of claim 1, wherein the reflective particles comprise at least one of titanium carbide, silicon carbide or zirconium carbide.

8. The part of claim 1, wherein the reflective melted regions are characterized as having a crystalline microstructure.

9. The part of claim 1, wherein the reflective particles have an average particle diameter ranging from about 100 nm to about 400 nm.

10. The part of claim 1, wherein the irregularly arranged pore structures are formed around the reflective particles.

11. The part of claim 1, wherein the metal oxide layer has a lightness L value ranging from about 85 to about 100.

12. An enclosure for an electronic device, the enclosure comprising:

a part comprising:

a metal substrate; and a metal oxide layer overlaying the metal substrate, the metal oxide layer including: an ordered region having substantially parallel pore structures that are arranged in an ordered manner and that extend from a top surface of the metal oxide layer to the metal substrate, such that, of an amount of light incident onto an external surface of the metal oxide layer, a portion of the amount of light passes through the substantially parallel pore structures and is reflected from the metal substrate, and reflective melted regions that are formed around a perimeter of the top surface of the metal oxide layer and are separated from each other and from the metal substrate by the ordered region such that the reflective melted regions are equidistant from each other, the reflective melted regions characterized as having a microstructure that is different than the ordered region, wherein the reflective melted regions include (i) irregularly arranged pore structures, and (ii) reflective particles capable of reflecting light there-from, wherein the reflective melted regions are separated from each other such that at least a remaining portion of the amount of light incident onto the external surface is reflected from the reflective particles and combines with the amount of light reflected from the metal substrate, thereby imparting the metal oxide layer with a white appearance.

13. The enclosure of claim 12, wherein the reflective particles have an average particle diameter ranging from about 100 nm and about 400 nm.

14. The enclosure of claim 12, wherein the reflective particles include at least one of titanium oxide, zirconium oxide, zinc oxide, aluminum oxide, aluminum, steel, chromium, titanium carbide, silicon carbide or zirconium carbide.

15. The enclosure of claim 12, wherein the irregularly arranged pore structures are formed around the reflective particles.

16. The enclosure of claim 12, wherein the reflective particles are spherically shaped.

17. An enclosure for an electronic device, the enclosure comprising:

a part comprising:

a metal substrate; and a metal oxide layer overlaying the metal substrate, the metal oxide layer including:

an ordered region having substantially parallel pore structures that are arranged in an ordered manner and that extend from a top surface of the metal oxide layer to the metal substrate such that, of an amount of light incident onto an external surface of the metal oxide layer, a portion of the amount of light passes through the substantially parallel pore structures and is reflected from the metal substrate, and reflective melted regions that are formed around a perimeter of the top surface of the metal oxide layer and are separated from each other and from the metal substrate by the ordered region such that the reflective melted regions are equidistant from each other, the reflective melted regions characterized as having a microstructure that is different than the ordered region, wherein the reflective melted regions include (i) irregularly arranged pore structures, and (ii) reflective particles capable of reflecting light there-from, wherein the reflective melted regions are separated from each other such that at least a remaining portion of the amount of light incident onto the external surface is reflected from the reflective particles and combines with the amount of light reflected from the metal substrate, thereby imparting a white appearance to the metal oxide layer.

18. The enclosure of claim 17, wherein the reflective particles include at least one of titanium oxide, zirconium oxide, zinc oxide, aluminum oxide, aluminum, steel, chromium, titanium carbide, silicon carbide, or zirconium carbide.

* * * * *